US006963325B2

(12) United States Patent
Yano et al.

(10) Patent No.: US 6,963,325 B2
(45) Date of Patent: Nov. 8, 2005

(54) DISPLAY DRIVING APPARATUS WITH COMPENSATING CURRENT AND LIQUID CRYSTAL DISPLAY APPARATUS USING THE SAME

(75) Inventors: Takeshi Yano, Nara (JP); Noriyuki Kajihara, Nara (JP); Yukihisa Orisaka, Nabari (JP)

(73) Assignee: Sharp Kabushiki Kaisha, Osaka (JP)

( * ) Notice: Subject to any disclaimer, the term of this patent is extended or adjusted under 35 U.S.C. 154(b) by 376 days.

(21) Appl. No.: 10/177,112

(22) Filed: Jun. 24, 2002

(65) Prior Publication Data

US 2003/0052851 A1 Mar. 20, 2003

(30) Foreign Application Priority Data

Sep. 14, 2001 (JP) ..... 2001-280533

(51) Int. Cl.[7] ..... G09G 3/28
(52) U.S. Cl. ..... 345/94; 345/211; 345/89
(58) Field of Search ..... 345/87–100, 204–213

(56) References Cited

U.S. PATENT DOCUMENTS 6,172,663 B1 * 1/2001 Okada et al. ..... 345/96
6,538,630 B1 * 3/2003 Tanaka et al. ..... 345/94
6,653,998 B2 * 11/2003 Lin et al. ..... 345/98
6,703,994 B2 * 3/2004 Edwards ..... 345/87

FOREIGN PATENT DOCUMENTS

| | | | |
|---|---|---|---|
| JP | 1-225996 | * | 9/1989 |
| JP | 06-161389 | | 6/1994 |
| JP | 09-222930 | | 8/1997 |
| JP | 11-272243 A | | 10/1999 |

* cited by examiner

*Primary Examiner*—Amr A. Awad
(74) *Attorney, Agent, or Firm*—Birch, Stewart, Kolasch & Birch, LLP

(57) ABSTRACT

In a display driving apparatus of the present invention and a liquid display apparatus using the same, a DC current is supplied to a reference voltage generating circuit from both ends of a resistance of the resistance divided circuit, via a bypass circuit, which is a bypass other than a route from a power source. This arrangement allows the reference voltage generating circuit itself to compensate current supply ability of a reference voltage supplied from the power source, even if an output circuit is omitted from the arrangement, thereby preventing a waveform of a gradation display voltage from having non-sharp rising and falling edges, or preventing variation in voltage due to charging and discharging of a pixel capacitor. This ensures an accurate gradation display voltage.

22 Claims, 19 Drawing Sheets

DISPLAY DRIVING APPARATUS WITH COMPENSATING CURRENT AND LIQUID CRYSTAL DISPLAY APPARATUS USING THE SAME

FIELD OF THE INVENTION

The present invention relates to a display driving apparatus for driving a liquid crystal panel (liquid crystal display section) and the like, and to a liquid crystal display apparatus including the display driving apparatus and the liquid crystal panel, especially to a method that realizes miniaturization and low electric power consumption of a circuit.

BACKGROUND OF THE INVENTION

FIG. 12 is a block diagram schematically showing a liquid crystal display apparatus 1 of the TFT (Thin Film Transistor) active matrix, which is a typical liquid crystal display apparatus. The liquid crystal display apparatus 1 is basically provided with a liquid crystal panel 2 and a liquid crystal driving apparatus for driving the liquid crystal panel 2. The liquid crystal panel 2, which is a liquid crystal panel of the TFT type, is provided with liquid crystal display elements (not shown) and opposite electrode (common electrode) 3.

On the other hand, the liquid crystal driving apparatus 1 is provided with a source driver SD, a gate driver GD, a controller CTL, and a liquid crystal driving power source REG. The source driver SD and the gate driver GD are respectively provided with an IC (Integrate Circuit). In general, the source driver SD and the gate driver GD are mounted by (1) connecting a film, on which a wire is formed and the IC chip is mounted, such as a TCP (Tape Carrier Package), with an ITO (Indium Tin Oxide) terminal of the liquid crystal panel 2, or by (2) thermo compressing the IC chip directly on the ITO terminal of the liquid crystal panel 2, via an ACF (Anisotropic Conductive Film).

Moreover, in order to attain the miniaturization of the liquid crystal display apparatus, the controller CTL, the liquid crystal driving power source REG, the source driver SD and the gate driver GD may be constituted of a signal chip or a few (two or three) chips. In FIG. 12, those arrangements are separately illustrated in terms of functions.

The controller CTL outputs, to the gate driver GD and the source driver SD, digitalized display data (for example, RGB signals respectively corresponding to red, green, and blue) and various control signals. The control signals for the source driver SD are mainly a horizontal synchronizing signal, a start pulse signal, and a source driver clock signal (a clock signal for the source driver SD), and the like signals. The control signals for the source driver SD are indicated by the reference mark S1 in the figure, while the display data is indicated by the reference mark D. On the other hand, the control signals for the gate driver GD are mainly a vertical synchronizing signal, and a gate-driver clock signal (a clock signal for the gate driver GD), and the like signals. The control signals for the gate driver GD are indicated by the reference mark S2. Note that a power source for driving the ICs is omitted in the figure.

The liquid crystal driving power source REG supplies the source driver SD and the gate driver GD with a display voltage for causing the liquid crystal panel 2 to display (in the present invention, a reference voltage for generating a gradation display voltage). The display data D, which is inputted externally, is inputted into the source driver SD via the controller CTL, in a form of a digital signal. The source driver SD latches the inputted display data D into itself, in a time-division manner. Thereafter, the source driver SD carries out DA (digital/analog) conversion, synchronously to the horizontal synchronizing signal (which is also called as a latch signal) LS, which is inputted from the controller CTL. Thereby, analog display voltages for display (for displaying gradation) are obtained. The analog display voltages are outputted, as gradation display voltages, respectively to liquid display elements (not shown) inside the liquid crystal panel 2, the liquid display element corresponding to liquid crystal driving voltage output terminals.

FIG. 13 is an equivalent circuit diagram illustrating the liquid crystal panel 2. One of substrates of the liquid crystal panel 2 is sectioned into a matrix by a plurality of gate signal lines G1, G2, to Gn (a reference mark G is used when the plurality of gate signal lines G1, G2 to Gn are referred to), and a plurality of source signal lines S1, S2, to Sn (a reference mark S is used when the plurality of gate signal lines S1, S2 to Sn are referred to). By dividing the substrate into a matrix in this manner, regions A are formed. Each region A, which is for one pixel, is provided with a pixel electrode 11 and a TFT 12 as a switching element for turning ON or OFF voltage application onto the pixel electrode 11. The pixel electrode 11 and the opposite electrode 3, which is provided on the other substrate, form a pixel capacitor 14.

The source signal lines S receive, from the source driver SD, the gradation display voltages, which correspond to brightness of display-target pixels (pixels to be used for displaying a certain screen image to be display at that time), whereas the gate signal lines G receive scanning signals so as to turn ON the TFTs 12 lined up in a vertical direction from a position at which the gate driver GD is located. Via the TFTs 12 thus turned ON, the gradation display voltages of the source signal lines S are applied onto the pixel electrodes 11, which are connected to drains of the TFTs 12. In this way, the gradation display voltage is stored in the pixel capacitor 14 between the pixel electrode 11 and the opposite electrode 3. Thereby, light transmittance of liquid crystal between the pixel electrode 11 and the opposite electrode 3 is changed, so as to display.

FIGS. 14 and 15 are views illustrating examples of a liquid crystal driving waveform. In those figures, the reference mark S shows a waveform of the gradation display voltage from the source driver SD, while the reference mark G shows a waveform of the scanning signal from the gate driver GD. Moreover, the reference number 3 indicates a potential of the opposite electrode 3, whereas the reference number 11 shows a voltage waveform of the pixel electrode 11. A voltage applied onto a liquid crystal material is potential difference between the pixel electrode 11 and the opposite electrode 3. The voltage applied onto the liquid crystal material is indicated by slanting strokes.

For example, in FIG. 14, when the scanning signal (indicated by the reference mark G) from the gate driver GD is at a High level, the TFT 12 is turned ON, so that a difference between (a) the gradation display voltage (indicated by the reference mark S) from the source driver SD and (b) the potential of the opposite electrode 3 is applied into the pixel electrode 11. Thereafter, as the reference mark G indicates, the scanning signal from the gate driver GD becomes a Low level, so that the TFT 12 is turned OFF. Here, the voltage is maintained in the pixel, because of the presence of the pixel capacitor 14.

FIG. 15 shows a similar operation. However, the voltages applied onto the liquid crystal materials are different between FIGS. 14 and 15. In FIG. 14, the applied voltage is higher than in FIG. 15. The light transmittance of the liquid crystal is altered in an analog manner, by changing the voltage applied onto the liquid crystal to be an analog voltage in this way. Thereby, a multi-gradation display is realized. How many gradations can be displayed is dependent on how many discrete levels of analog voltages can be applied into the liquid crystal. The present invention relates to a reference voltage generating circuit and an output circuit in a gradation display circuit. The reference voltage generating circuit and the output circuit occupy a large area in the gradation display circuit, and consume a large electric power. Hereinafter, the liquid crystal driving apparatus is explained, mainly discussing the source driver SD.

FIG. 16 is a block diagram illustrating an arrangement of a typical conventional source driver 20 used as the source driver SD. Only basic parts of the source driver 20 are explained below. Digital display data DR, DG, and DB (for example in 6 bits) are transmitted from the controller CTL, and temporarily latched by an input latch circuit 21. Note that the digital display data DR, DG, and DB respectively correspond to red, green, and blue colors.

On the other hand, the start pulse signal SP, which is synchronized to the clock signal CK, is transmitted through a shift register circuit 22, and outputted, as a start pulse signal SP (cascade signal S), from a last stage of the shift register circuit 22 to a source driver, which is the next stage in the process. The digital display data DR, DG, and DB, which have been latched by the input latch circuit 21 synchronously to the output signals from the respective stages of the shift register circuit 22, are temporally stored in a sampling memory circuit 23 in a time-division manner, and are outputted to a hold-memory circuit 24, which is the next stage in the process.

When display data of one horizontal synchronizing period is stored in the sampling memory circuit 23 in this manner, the hold-memory circuit 24 accepts an output signal from the sampling memory circuit 23 in accordance with a horizontal synchronizing signal LS, and holds the display data until a next horizontal synchronizing signal LS is inputted. Conversion of an output signal from the hold-memory circuit 24, such as voltage boosting of the output signal, is carried out by a level shifter circuit 25 so as to be in conformity with a signal level of a DA converting circuit 26, which is the next stage in the process.

The DA converting circuit 26 selects one analog voltage from among a plurality of analog voltages from a reference voltage generating circuit 27 in accordance with the display data subjected to the level conversion by the level shifter circuit 25, and generates an applied voltage level (the gradation display voltage) to be applied into the liquid crystal panel 2. In accordance with a reference voltage VR from the liquid crystal driving power source REG, the reference voltage generating circuit 27 generates various analog voltages for the gradation display, and outputs the analogs voltages to the DA converting circuit 26. The analog voltage, which realizes the gradation display, is outputted as the gradation display voltage, from each liquid crystal driving voltage output terminal (hereinafter, just refereed to as an output terminal) 29 to each source signal line S via an output circuit 28. The output circuit 28 is basically a buffer circuit, and is realized by a voltage follower circuit using, for example, a differential amplification circuit.

Next, explained in detail are circuit arrangements of the reference voltage generating circuit 27 and the DA converting circuit 26, to which the present invention especially relate. FIG. 17 is a view illustrating the circuit arrangement of the reference voltage generating circuit 27. In case the digital display data corresponding to RGB are, for example, respectively in 6 bits, the reference voltage generating circuit 27 outputs analog voltages of 64 kinds, that is, V0 to V63, so as to deal with 64 (=$2^6$) kinds of gradation display respectively. In the following, the specific arrangement is explained.

The reference voltage generating circuit 27 has such a simple arrangement that the reference voltage generating circuit 27 is constituted by a resistance divided circuit in which resistances R0 to R7 are connected in series. Each of the resistances R0 to R7 is connected, in series, with eight (8) resistance elements. Specifically, for example, discussing about the resistance R0 by way of explanation, the resistance R0 is constituted by eight resistance elements R01, R02 to R08, which are connected in series, as shown in FIG. 18. Moreover, the other resistances R1 to R7 have the same arrangement as the resistance R0. Therefore, the reference voltage generating circuit 27 is constituted by 64 resistance elements in total, which are connected in series.

Moreover, the reference voltage generating circuit 27 includes nine (9) voltage input terminals that correspond to nine (9) kinds of references voltages V'0, V'8, to V'56, and V'64. Further, an end of the resistance R0 is connected with the voltage input terminal that corresponds to the reference voltage V'64, and the other end of the resistance R0, that is, a node between the resistances R0 and R1 is connected with the voltage input terminal that is for halftone and corresponds to the reference voltage V'56. (Hereinafter, the voltage input terminals that are for halftone are referred to as the halftone voltage input terminals.) Similarly, each node between the resistances next to each other is connected with the halftone voltage input terminal, that is, the nodes between the resistances R1 and R2, R2 and R3, to R6 and R7 are respectively connected with the halftone voltage input terminals that respectively correspond to the reference voltages V'48, V'40, to V'8. The other end of the resistance R7 is connected with the voltage input terminal that corresponds to the reference voltage V'0.

With those arrangements, it is possible to obtain the 63 kinds of analog voltages V1 to V63 respectively from nodes between pairs of the 64 resistance elements. This gives the 64 kinds of the analog voltages V0 to V63 for gradation display, by summing up the analog voltages V1 to V63 and the analog voltage V0 that is obtained from the reference voltage V'0 without such process. Where the reference voltage generating circuit 27 is constituted of a resistance divided circuit as described above, the analog voltages V0 to V63 are determined by differences between the resistances. The analog voltages V0 to V63 are inputted from the reference voltage generating circuit 27 to the DA converting circuit 26.

Note that, in general, there is a case where the two reference voltages located on the both ends, namely, V'0 and V' 64, are inputted into the voltage input terminals all the time, whereas the 7 halftone voltage input terminals corresponding to the remaining reference voltages V'8 to V'56 are used for fine adjustment. Practically, there is a case where no voltage is inputted into those terminals.

Next, explained is the DA converting circuit 26. FIG. 19 is a view illustrating an example of an arrangement of the DA converting circuit 26. Note that the reference mark 28 indicates the arrangement of the output circuit 28 (voltage follower circuit) in the figure. The DA converting circuit 26, broadly speaking, includes a MOS transistor or a transmission gate as analog switches, so that one of the 64 kinds of analog voltages V0 to V63 thus inputted are selected in accordance with display data composed of digital signals Bit0 to Bit5 in 6 bits. In other words, the analog switches are turned ON or OFF in accordance with the display date composed of the digital signals Bit0 to Bit5 in 6 bits, respectively.

Hereinafter, this arrangement is explained in detail. As to the digital signals Bit0 to Bit5 in 6 bits, the digital signal Bit0 represents LSB, and the Bit5 represents MSB. The analog switches constitute switching pairs, which are two analog switches in pairs. The digital signal Bit0, which represents LSB, corresponds to thirty two (32) switching pairs (sixty four (64) analog switches SW0), while the digital signal Bit1 correspond to sixteen switching pairs (thirty two (32) analog switches SW1). Similarly, for the rest of the digital signals Bit2 to Bit5, as the reference number of bit is increased, a number of the analog switches corresponding to the digital signal are halved (in short, sixteen analog switches correspond to the digital signal Bit2, while 8 analog switches correspond to the digital signal Bit3). Thus, only a pair of analog switches (two analog switches) corresponds to the MSB digital signal Bit5. Therefore, in total, there are 63 pairs (32+16+8+4+2+1=63) of analog switching pairs (that is, 126 analog switches).

Ends of the analog switches SW0 that correspond to the digital signal Bit0 that represents LSB are terminals that receives the analog voltages V0 to V63 respectively. Further, the other end of the analog switches SW0 are connected in pairs, and connected to ends of the analog switches that correspond to the digital signal Bit1 that is next to the digital signal Bit0. The rest of the analog switches, including the analog switches SW5 corresponding to the MSB digital signal Bit5, are arranged in a similar manner, so that an other end (which corresponds to the other end of the analog switch SW0) of the analog switch SW5 is connected to the output circuit 28. The analog switches SW0 to SW5 are controlled in the following manner, in accordance with the digital signal Bit0 to Bit5 in 6 bits.

As to each of the analog switches SW0 to SW5, when its corresponding one of the digital signals Bit0 to Bit5 is "0" (Low level), one of the analog switches in pairs (in FIG. 19, lower one of the analog switches) is turned ON, whereas the other one of the analog switches (in FIG. 19, upper one of the analog switches) is turned ON when its corresponding one of the digital signals Bit0 to Bit5 are "1". FIG. 19 illustrates a case where the display data described by the digital signals Bit0 to Bit5 is "111111", thus all the upper switches are ON and all the lower switches are OFF for all the switching pairs. In this case, the analog voltage V63 is outputted from the DA converting circuit 26 to the output circuit 28. Similarly, for example if the display data is "111110", the analog voltage V62 is outputted from the DA converting circuit 26 to the output circuit 28. When the display data is "000001", the analog voltage V1 is outputted. The analog voltage V0 is outputted if the display data is "000000". In this manner, one of the analog voltages V0 to V63 for gradation display is selected in accordance with the digital display data, so as to realize the gradation display.

In addition, in actual gradation display of the liquid crystal display apparatus, γ correction is carried out for adjusting differences between light transmittance characteristics of the liquid crystal material and visual characteristics of humans in order to perform natural gradation display. For the γ correction, it is a general method that the resistance elements are unevenly, that is, not evenly, divided in order that the reference voltage generating circuit 27 generates the analog voltages V0 to V63 for gradation display.

FIG. 20 is a graph showing a relationship between the display data composed of the digital signal Bit0 to Bit5 in the 6 bits and liquid crystal driving output voltages (the analog voltages V0 to V63), in case the γ correction is carried out. As shown in FIG. 20, the values of the analog voltages plotted with respect to the display data have polygonal characteristics. In order to realize the characteristics, the reference voltage generating circuit 27 shown in FIG. 17 carries out the γ correction by setting the ratio of the resistance values of the respective resistances R0 to R7 to be a ratio with which the γ correction can be realized.

In the conventional source driver 20 having the above arrangement, usually a single of the reference voltage generating circuit 27 is provided in one of IC chips in the source driver SD, for shared usage among the IC chips. On the other hand, the DA converting circuit 26 and the outputting circuit 28 are provided corresponding to each output terminal 29. Moreover, in case of color display, the output terminals 29 are used respectively corresponding to the colors. Thus, in this case, the DA converting circuit 26 and the output circuit 28 are provided to each color in each pixel. Specifically, where there are an N number of pixels along a longitudinal direction of the liquid crystal panel 2, and where R, G, B, indicates the colors, and associating number n (n=1, 2, to N), the output terminals 29 for the respective red, green and blue colors are marked as: R1, G1, and B1; R2, G2, and B2; to; RN, GN, and BN. Thus, a 3N number of the DA converting circuit 26 and the outputting circuit 28 are necessary.

Especially, the output circuit 28, which is as described above constituted by the differential amplifier, and which is an analog circuit, need a large layout area and consumes a large electric power. To provide the output circuit 28 to each output terminal 29 is a serious problem for a display apparatus for a portable apparatus, in which miniaturization and low electric power consumption are especially demanded.

On the other hand, even though it depends on an output impedance of the pixel capacitor 14, which is a load, and the resistances R0 to R7 of the reference voltage generating circuit 27, for a liquid crystal panel for a small or medium size, for example, of 560×240 pixels, it is possible to omit the output circuit 28, so as to output the liquid crystal driving voltage directly from the respective resistances R0 to R7 via the analog switches SW0 to SW5. However, since the liquid crystal driving electric power REG of low electric power consumption is provided, each voltage line for outputting the reference voltage VR to the reference voltage generating circuit 27 has a small current supplying ability. Because of this, when the output circuit 28 is omitted, such problems may be caused that a waveform of the liquid crystal driving voltage has non-sharp rising and falling edges, or that variation in voltage caused by charging and discharging the pixel capacitor 14 shifts γ characteristics described above, even if the resistance values of the respective resistances R0 to R7 are appropriately set.

SUMMARY OF THE INVENTION

The present invention has an object of providing a liquid crystal display apparatus capable of generating, with low electric power consumption, an accurate gradation display voltage that corresponds to a display image, and a liquid crystal display apparatus using the same.

A display driving apparatus of the present invention is provided with (a) a reference voltage generating section for generating, by dividing a reference voltage, a plurality of analog voltages for gradation display, the reference voltage being a DC voltage inputted from a power source, and (b) a selection section for selecting a voltage corresponding to inputted display data from among the plurality of analog voltages for the gradation display, and for outputting thus selected voltage to a display panel as a gradation display voltage for driving a display element, wherein the reference voltage generating section includes (c) a dividing section for dividing the reference voltage, and (d) a bypass section for supplying a DC current at least from both ends of the dividing section, as a bypass other than a route from the power source.

With this arrangement, for the display driving apparatus, which is realized as a source driver of a liquid crystal driving apparatus or the like, and in which the reference voltage generating section generates the plurality of analog voltages (for example, V63 to V0) by dividing the DC reference voltage by means of the resistance dividing section or the like, and the selection section selects the voltage corresponding to the inputted display data, so that the analog voltage is outputted directly to a display panel, but not via an output circuit such as a voltage follower circuit, the bypass circuit supplies the DC current at least from both ends of the dividing section, that is, from between terminals from which a maximal reference voltage is applied onto the dividing section, as a bypass other than a route from the power source.

Therefore, it is possible for the display driving apparatus to compensate current supplying ability of the reference voltage supplied from a power source, even if it is so arranged that no output circuit is provided and the gradation display voltage, which is for driving a display element, is directly outputted to the display panel. Thus, it is possible to prevent a waveform of the liquid crystal driving voltage from having non-sharp rising and falling edges, or to prevent variation in voltage due to charging and discharging of the pixel capacitor.

This ensures an accurate gradation display voltage in which a shift in $\gamma$ characteristics is suppressed. Moreover, in case it is so arranged that one reference voltage generating section is provided in an IC of the display driving apparatus, an increase in electric power consumption due to a bypass DC current of the dividing section thereof is sufficiently smaller than that caused in an arrangement in which each output terminal is provided with an output circuit. This leads to lower electric consumption. Furthermore, this arrangement has a significantly smaller circuit space.

Furthermore, the reference voltage generating circuit of the present invention, in which the bypass circuit is added to a layout having a power source and a conventional reference voltage generating circuit, can be applied to a liquid crystal panel having a pixel capacity larger than that of what the liquid crystal panel is conventionally specified (specification of the liquid crystal panel). This enables the liquid crystal panel to be altered easily as to what the liquid crystal panel is specified (specification of the liquid crystal panel), and gives wider applicability to the IC of the display driving apparatus. This leads to mass production of the IC (producing mass production effect as to the IC), which lowers a cost of the IC.

Moreover, a resistance of a power source wire between the power source and the display driving apparatus can be increased by reinforcing the power supply near the selection section in the display driving apparatus. This reduces noise interference, thereby improving display quality.

In addition, for a case where intermediate gradation, such as the analog voltages other than those from the both ends of the dividing section, is used frequently, it may be so arranged that the bypass section supply the DC current to the analog voltages other than those from the both ends of the dividing section.

Moreover, a liquid crystal display apparatus of the present invention is provided with a display driving apparatus having any one of those arrangements described in this specification and claims.

For a fuller understanding of the nature and advantages of the invention, reference should be made to the ensuing detailed description taken in conjunction with the accompanying drawings.

DESCRIPTION OF THE EMBODIMENTS

An embodiment of the present invention is described below.

Figure 1:
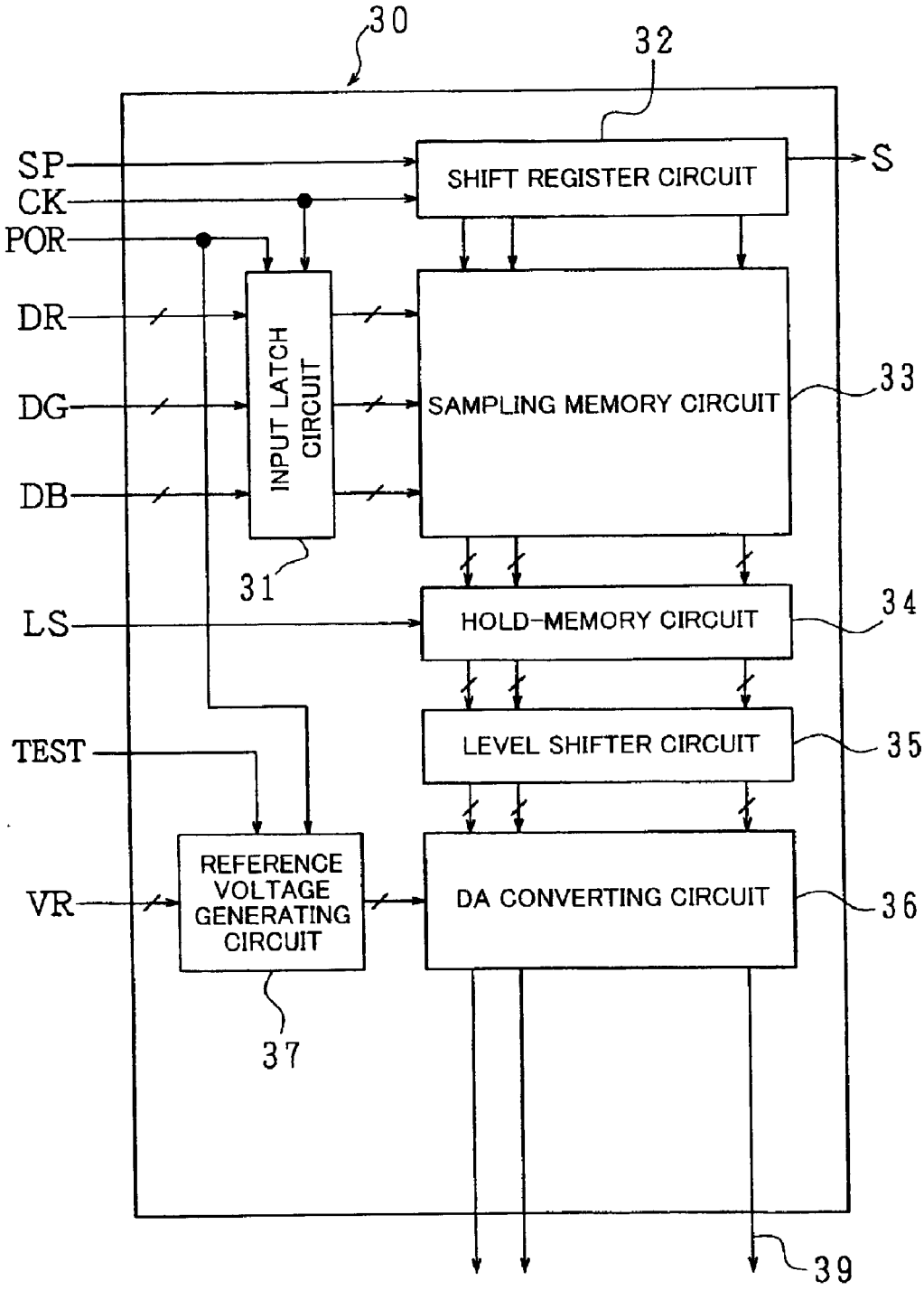
FIG. 1 is a block diagram illustrating a source driver that is a display driving apparatus of an embodiment of the present invention.
Figure 12:
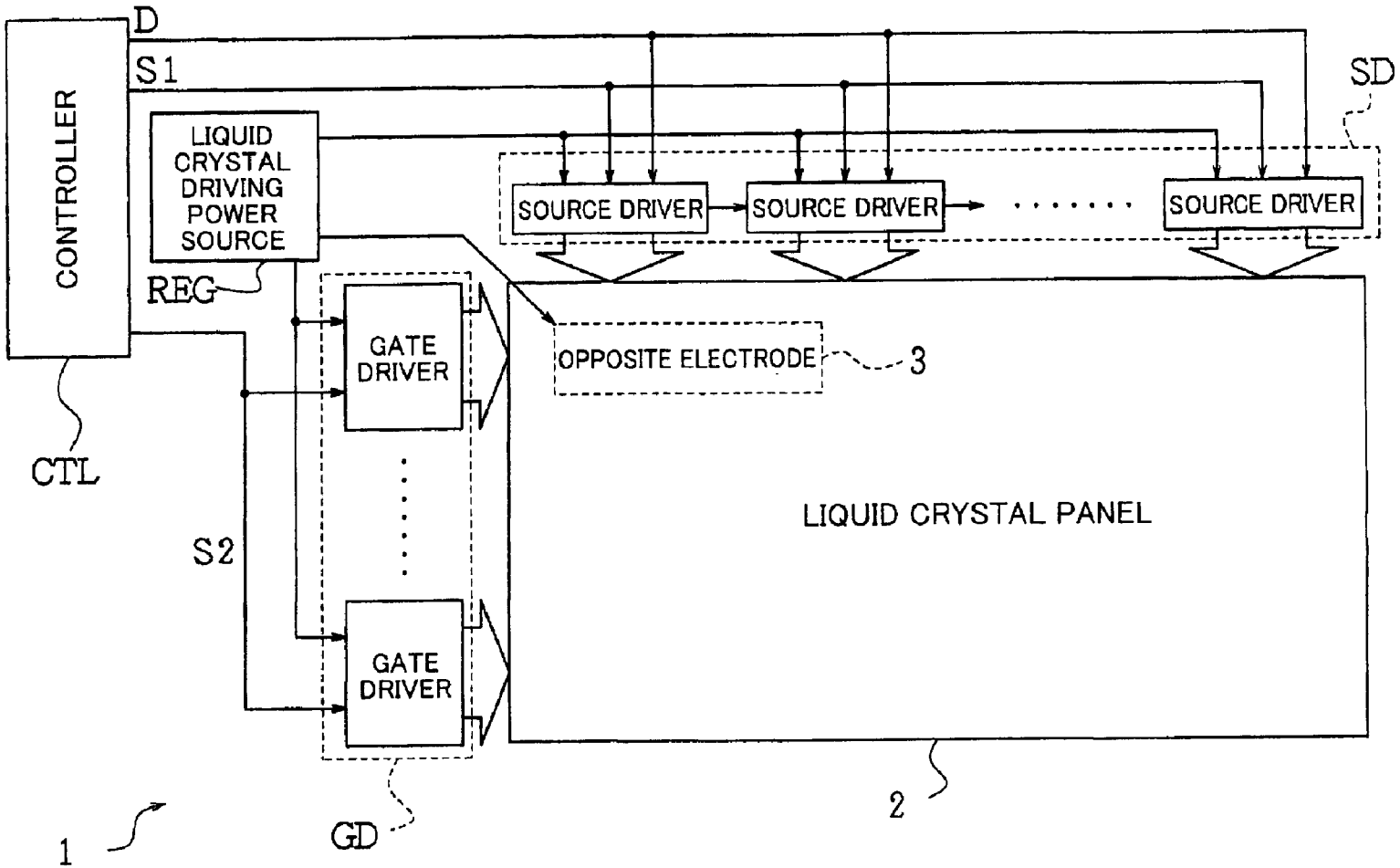
FIG. 12 is a block diagram showing an arrangement of a liquid crystal display apparatus of the TFT active matrix type.
Figure 13:
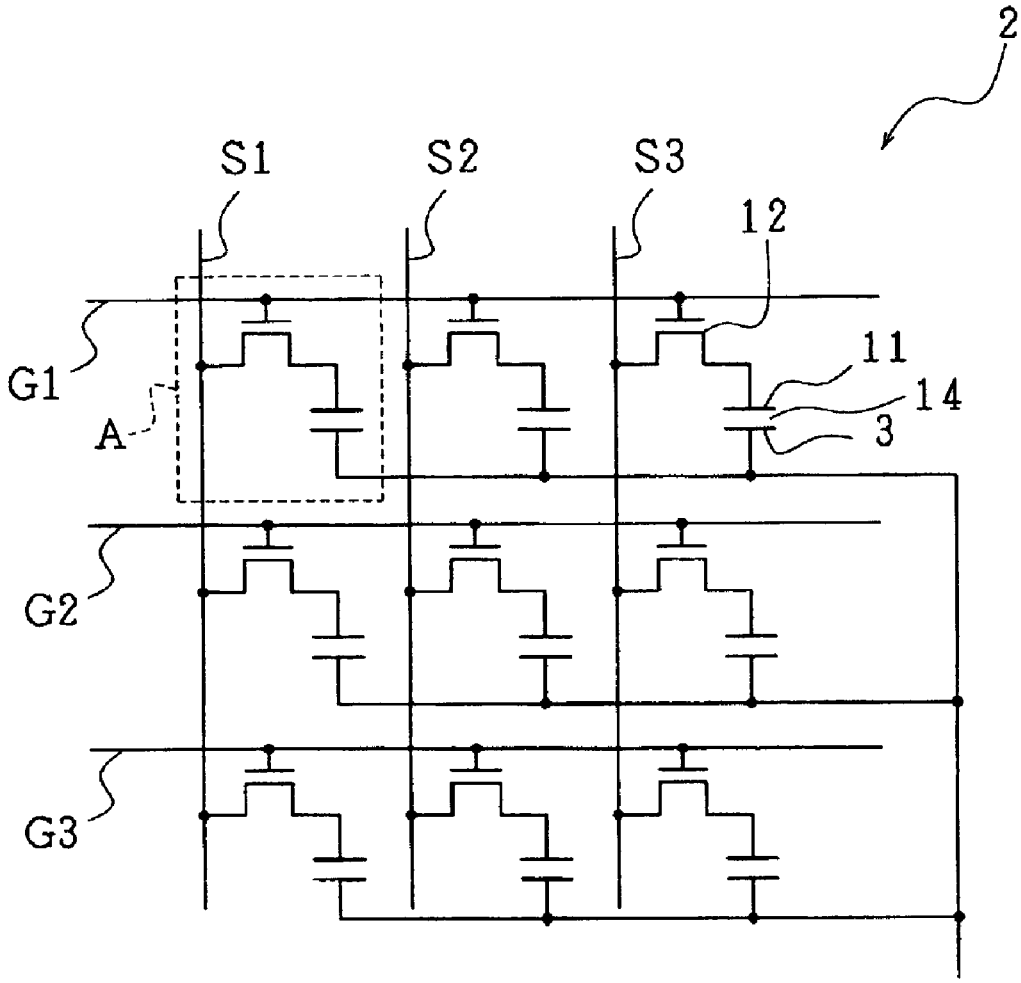
FIG. 13 is an equivalent circuit diagram showing a liquid crystal panel.
Figure 14:
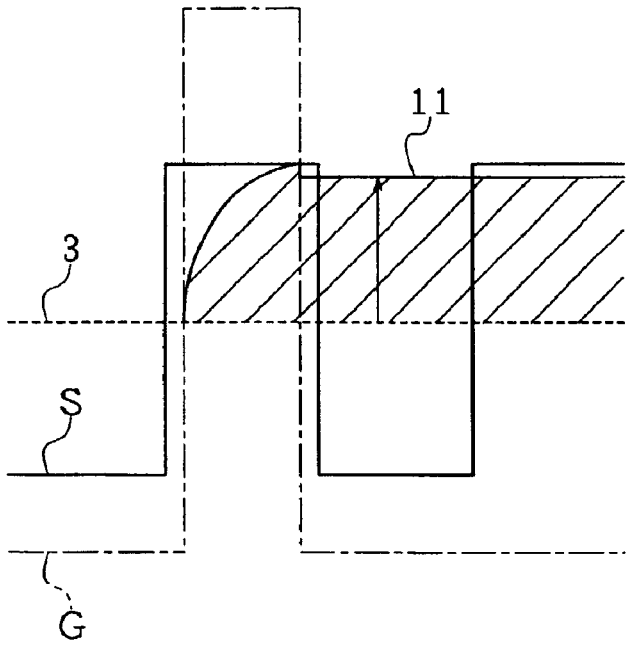
FIG. 14 is a view illustrating an example of a liquid crystal driving waveform.
Figure 15:
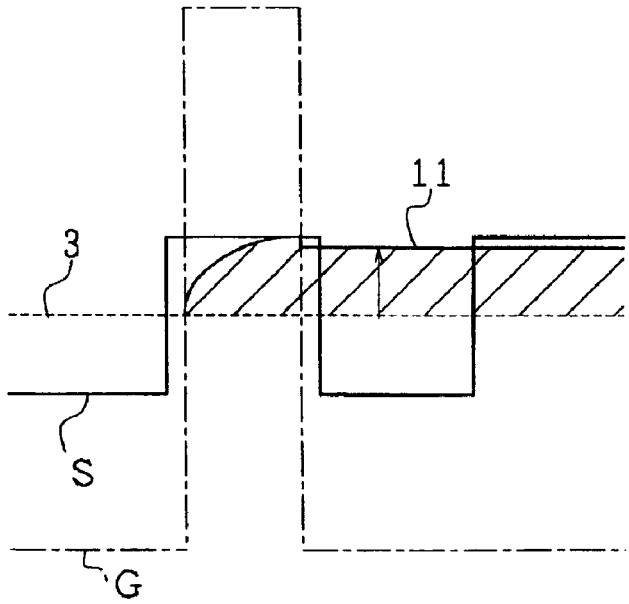
FIG. 15 is a view showing another example of the liquid crystal driving waveform.
Figure 16:
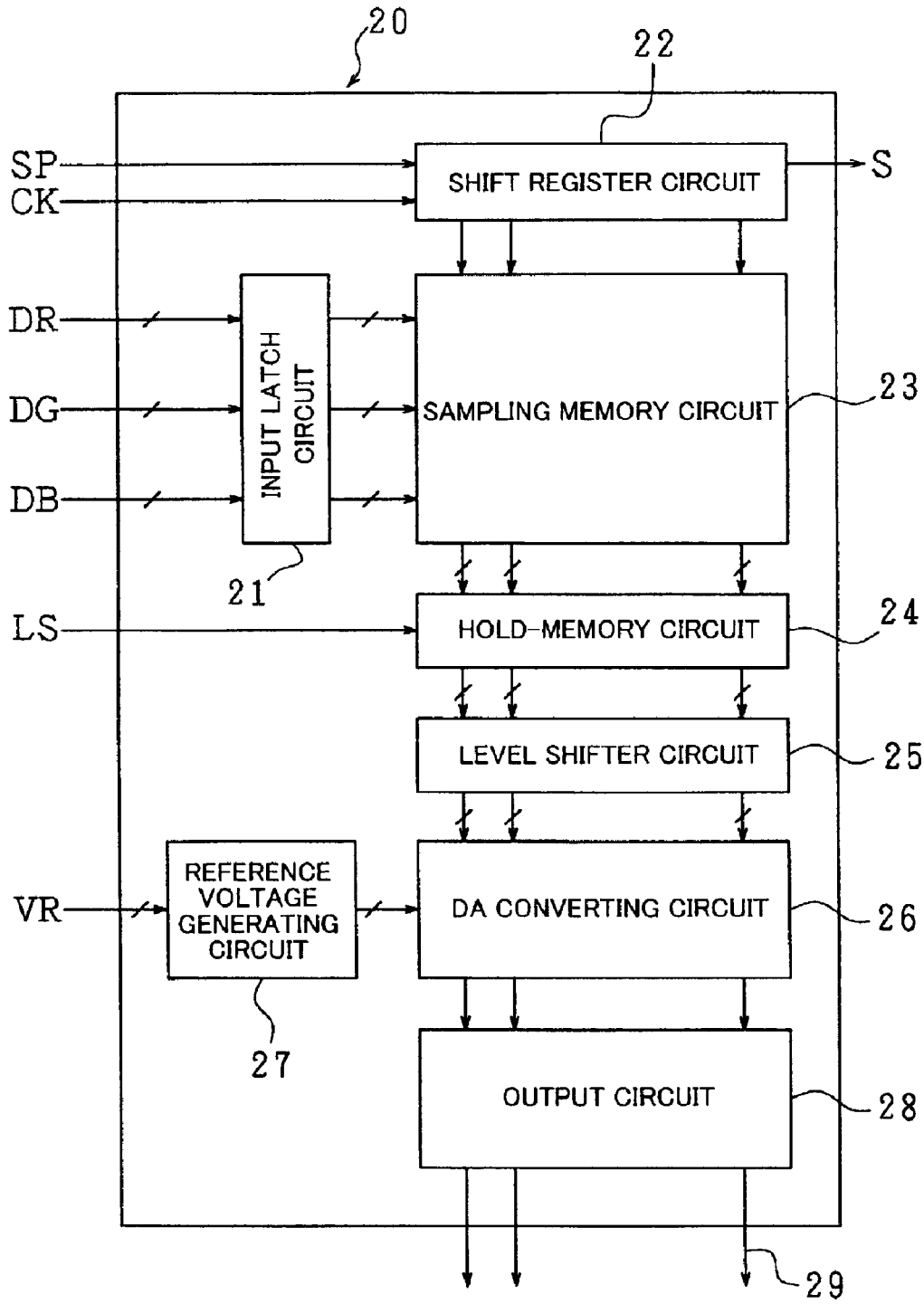
FIG. 16 is a block diagram illustrating an arrangement of a typical conventional source driver.
Figure 17:
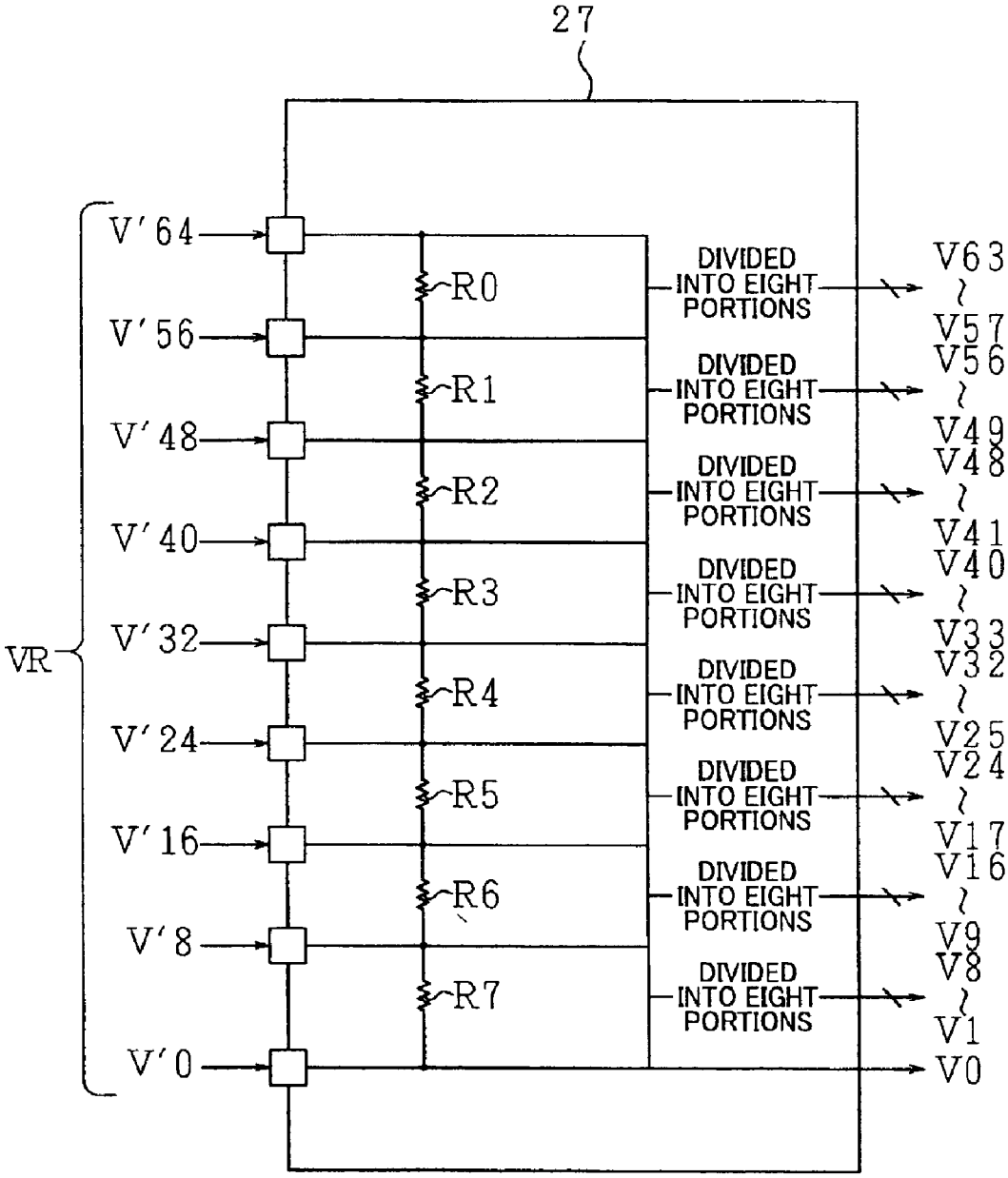
FIG. 17 is a view illustrating a circuit arrangement of a reference voltage generating circuit of the source driver shown in FIG. 16.

FIG. 1 is a block diagram illustrating a source driver 30 that is a display driving apparatus of the embodiment of the present invention. The source driver 30 is used as a source driver SD shown in previously discussed FIG. 12, while a liquid crystal display apparatus has a similar overall arrangement to that of a liquid crystal display apparatus of FIG. 12, except the source driver 30. A liquid crystal panel 2 has an arrangement shown in FIG. 13, and liquid crystal driving waveforms shown in FIGS. 14 and 15. Therefore, their explanation is omitted here.

The source driver 30 is provided with an input latch circuit 31, a shift register circuit 32, a sampling memory circuit 33, a hold-memory circuit 34, a level shifter circuit 35, a DA converting circuit 36, and a reference voltage generating circuit 37. The input latch circuit 31 latches respective digital display data DR, DG, and DB (for example, each of them is in 6 bits), which are transferred from a controller CTL shown in FIG. 12.

On the other hand, a start pulse signal SP is, in synchronism with a clock signal CK, transferred through the shift register circuit 32, and outputted from a last stage of the shift register circuit 32 to a next source driver, as a start pulse signal SP (cascade signal S). In synchronism with an output signal from each stage of the shift register circuit 32, the digital display data DR, DG, and DB, latched by the input latch circuit 31, are temporary stored in the sampling memory circuit 33 in a time-division manner, and are outputted to the hold-memory circuit 34 of the following stage.

When the display data for one horizontal synchronizing period is stored in the sampling memory circuit 33, the hold-memory circuit 34 acquires an output signal from the sampling memory circuit 33 in accordance with a horizontal synchronizing signal LS, and holds the display data until a next horizontal synchronizing signal LS is inputted. Conversion of an output signal from the hold-memory circuit 34, such as voltage boosting of the output signal, is carried out by the level shifter circuit 35 so as to be in conformity with a signal level of the DA converting circuit 36, which is the next stage in the process.

Figure 2:
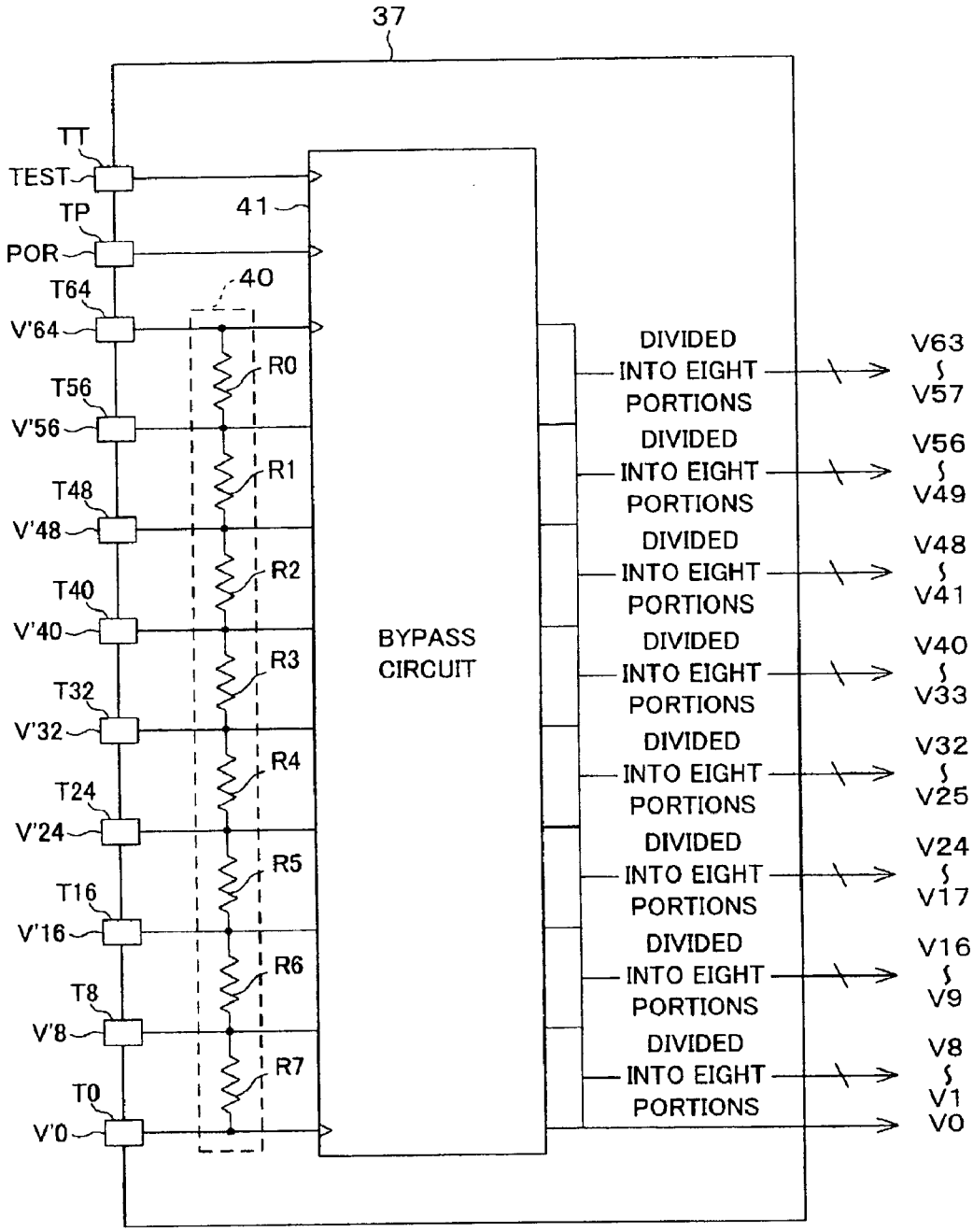
FIG. 2 is a view illustrating a circuit arrangement of a reference voltage generating circuit in the source driver shown in FIG. 1.

In accordance with the display data that has been subjected to the level conversion by the level shifter circuit 35, the DA converting circuit 36 selects one of a plurality of analog voltages that are from the reference voltage generating circuit 37, and generates an applied voltage level (the gradation display voltage previously described) to be applied onto the liquid crystal panel 2 shown in FIG. 2. The reference voltage generating circuit 37 generates various analog voltages for gradation display in accordance with a reference voltage VR from a liquid crystal driving power source REG, and outputs the various analog voltages to the DA converting circuit 36. The analog voltages for realizing the gradation display are outputted as the gradation display voltage via an output terminal 39 from the DA converting circuit 36 respectively to source signal lines S of the liquid crystal panel 2. In other words, the source driver 30 is provided with no output circuit 28 that is provided in a conventional source driver 20. Instead, the source driver 30 so arranged that the output from the DA converting circuit 36 be directly supplied to the liquid crystal panel 2. The reference voltage generating circuit 37 is different from a conventional reference voltage generating circuit 27. The following description discusses this point.

Figure 18:
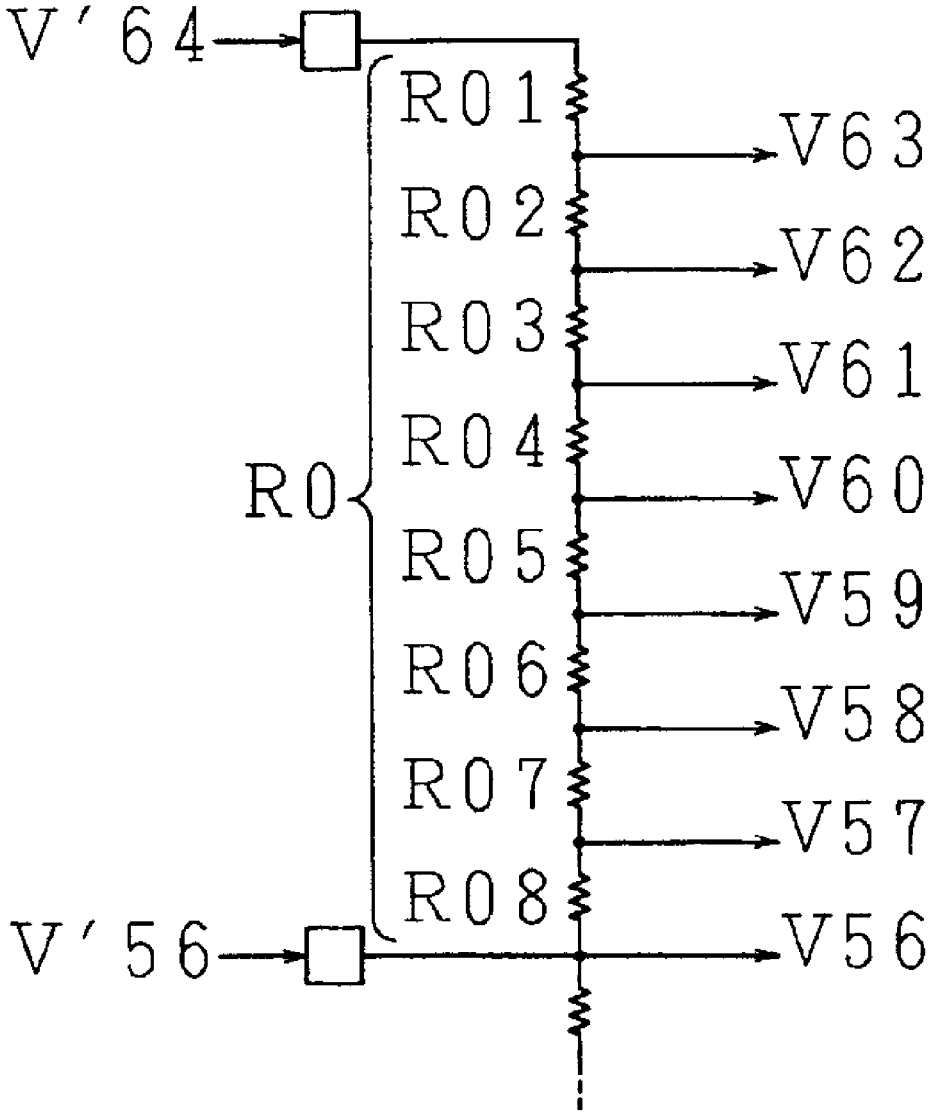
FIG. 18 is an electrical circuit diagram showing an arrangement of a resistance in the reference voltage generating circuit.

FIG. 2 is a circuit arrangement of the reference voltage generating circuit 37. Schematically, in case the digital display data for RGB are respectively in 6 bits for example, the reference voltage generating circuit 37 outputs analog voltages V0 to V63 of 64 kinds that respectively correspond to 64 ($=2^6$) gradation displays. The reference voltage generating circuit 37 is provided with a resistance divided circuit 40 in which resistances R0 to R7 are connected in series, like the reference voltage generating circuit 27. Each of the resistances R0 to R7 is constituted of eight resistance elements connected in series, for example as shown in FIG. 18.

Moreover, the reference voltage generating circuit 37 is provided with nine voltage input terminals T0, T8, to T56, and T64, which correspond to 9 kinds of reference voltages V'0, V'8, to V'56 and V'64. One end of the resistance R0 is connected with the voltage input terminal T64 that corresponds to the reference voltage V'64, whereas the other end of the resistance R0, that is, a node between the resistances R0 and R1, is connected with the voltage input terminal T56 for halftone (the halftone input terminal T56) that corresponds to the reference voltage V'56. Similarly, nodes of pairs of the adjoining resistances R1 and R2, R2 and R3, to R6 and R7, are respectively connected with the halftone input terminals T48 to T8 that respectively correspond to the reference voltages V'48, V'40, to V'8. The other end of the resistance R7 is connected with the voltage input terminal T0 that corresponds to the reference voltage V'0.

With this arrangement, it is possible to extract the 63 kinds of analog voltages V1 to V63 from between the pairs of adjoining resistance elements among the 64 resistance elements. Then, the analog voltages V0 to V63 of 64 kinds are obtained by summing the analog voltages V1 to V63 and the analog voltage V0 that is obtained from the reference voltage V'0 without any process. When the reference voltage generating circuit 37 is provided with a resistance divided circuit as described above, the analog voltages V0 to V63 are determined in accordance with resistance ratios.

Figure 20:
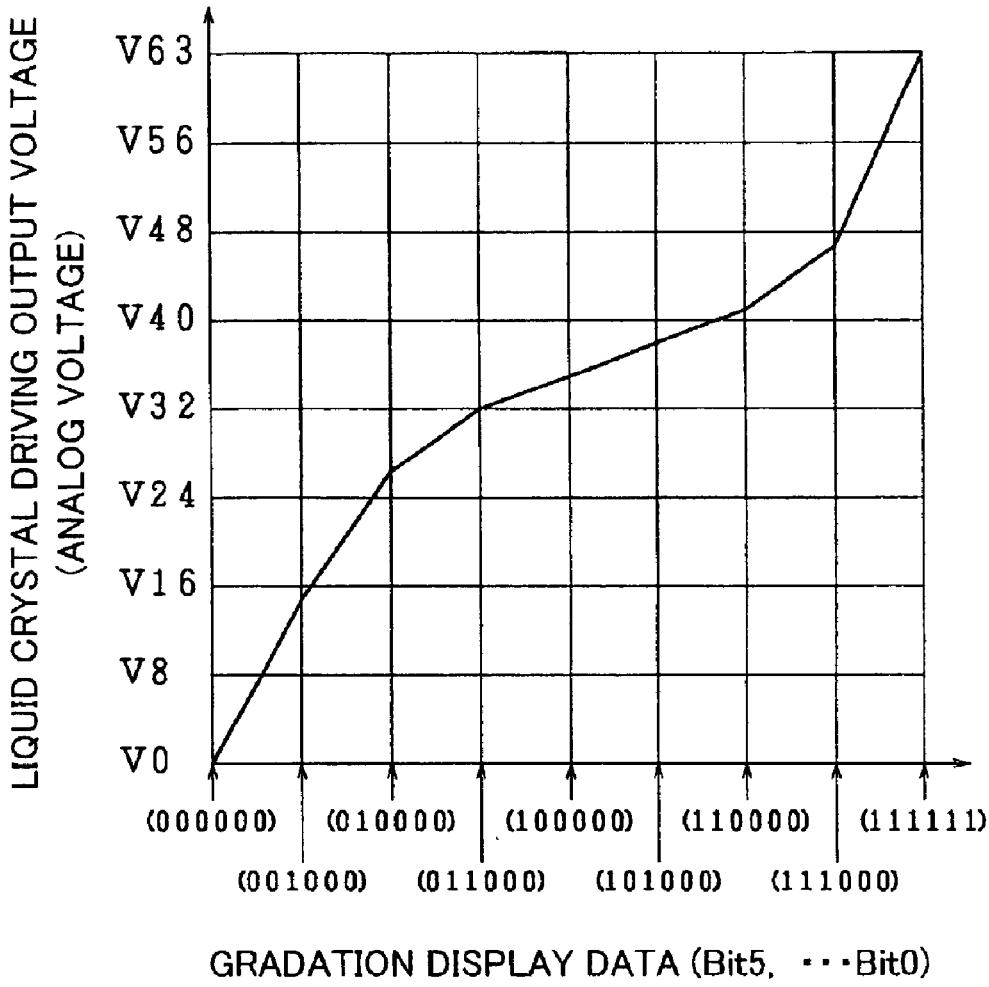
FIG. 20 is a graph showing a relationship between a display data in 6 bits and a liquid crystal driving output voltage, when γ correction is carried out.

The resistance ratios among the resistances R0 to R7 are set to be ratios that realize γ correction for natural gradation display with consideration for differences between human visual characteristics and light transmittance characteristics of a liquid crystal raw material of an actual liquid crystal display apparatus. In short, the resistance ratios are so set that the gradation display voltage has polygonal characteristics shown in FIG. 20, in accordance with data for gradation display. Therefore, the resistance divided circuit 40 is so arranged that its internal resistances are not evenly divided, but unevenly divided. The analog voltages V0 to V63 are inputted from the reference voltage generating circuit 37 to DA converting circuit 36.

Figure 3:
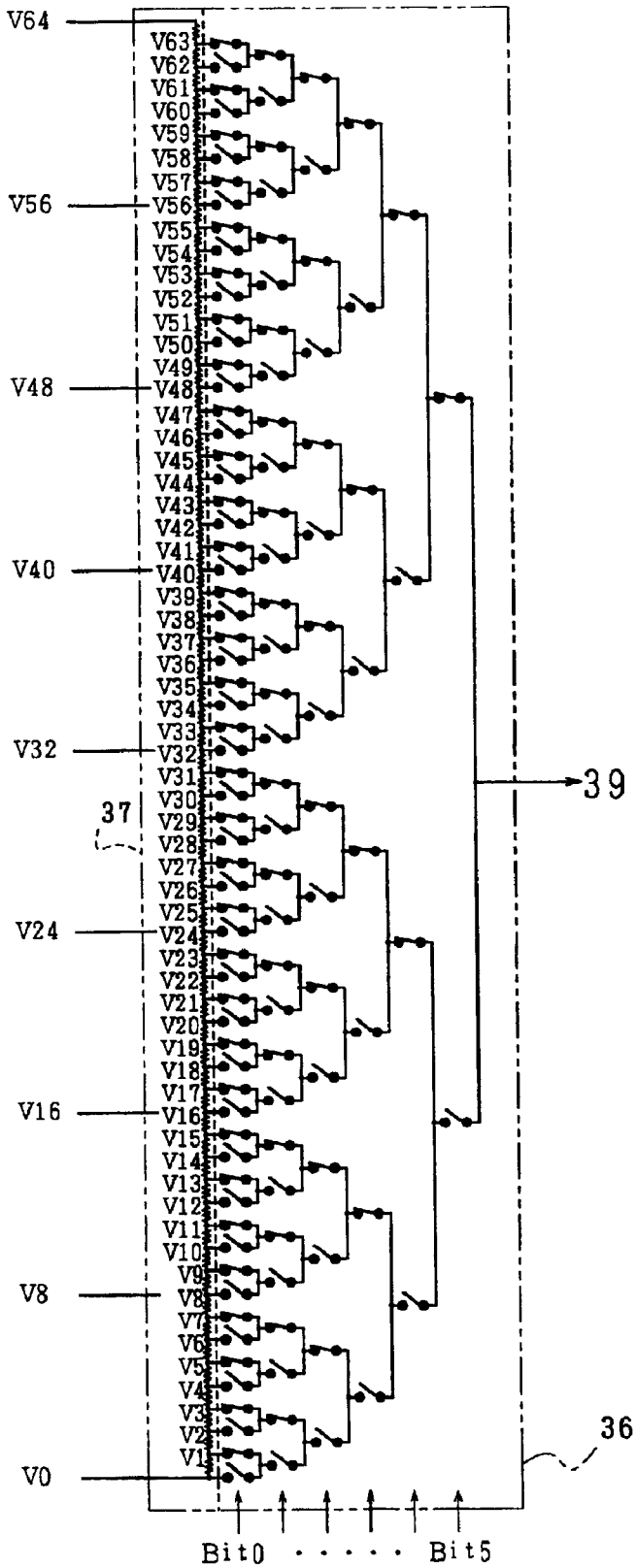
FIG. 3 is an electrical circuit diagram showing an arrangement from the reference voltage generating circuit to a DA converting circuit.
Figure 19:
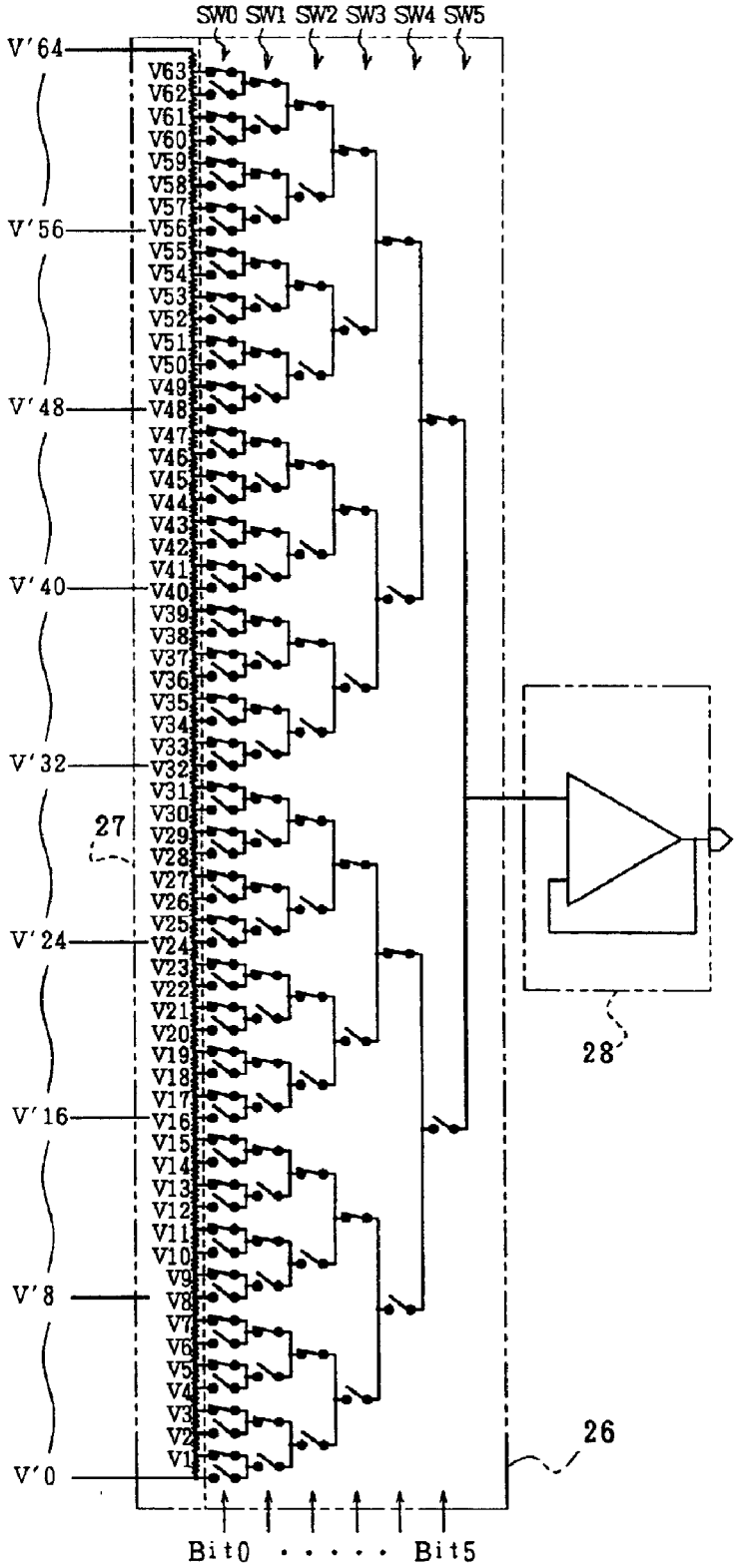
FIG. 19 is a view illustrating a structural example of a DA converting circuit.

FIG. 3 is an electrical circuit diagram illustrating an arrangement from the reference voltage generating circuit 37 to the DA converting circuit 36. The DA converting circuit 36 has the same arrangement as the previously discussed conventional DA converting circuit 26 shown in FIG. 19. Moreover, the output circuit 28 is omitted in the arrangement of the DA converting circuit 36, while the output circuit 28 is conventionally provided in each output terminal. Therefore, the analog voltages V0 to V63 for gradation display are selected in accordance with digital data Bit0 to Bit5 by the DA converting circuit 36, and the analog voltages V0 to V63 are applied onto the source signal lines S of the liquid crystal panel 2 as liquid crystal driving voltages. Next, characteristic feature of the present invention as to the reference voltage generating circuit 37 is explained in detail below.

It should be noted that the reference voltage generating circuit 37 is provided with a bypass circuit 41, in addition to the resistance divided circuit 40 that is constituted of the resistances R0 to R7. In the resistance divided circuit 40, the bypass circuit 41 supplies a DC current, as a bypass, to among the voltage input terminals T64 to T0 that are to receive at least maximum voltages from the liquid crystal driving power source REG, so as to reinforce DC currents from the liquid crystal driving power source REG. For this reason, the reference voltage generating circuit 37 is provided with (a) an input terminal TT for receiving a control signal TEST externally inputted, for example, from the previously mentioned controller CTL, (b) an input terminal TP for receiving a polarity-inverted signal POR, and (c) the bypass circuit 41, which is provided with later-described power elements for supplying the DC current, and a logic circuit for controlling the power elements in accordance with the control signal TEST and the polarity-inverted signal POR.

Figure 4:
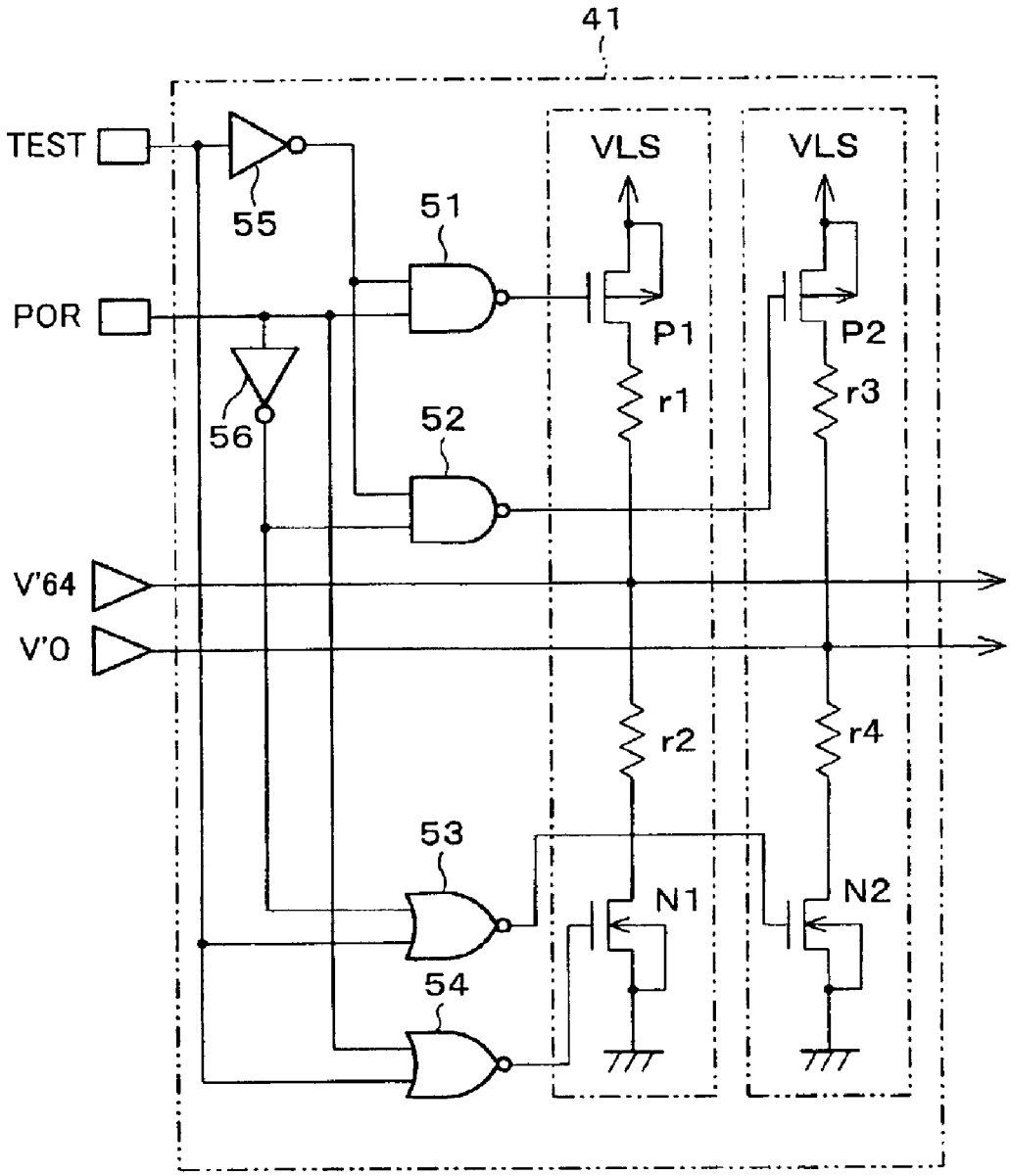
FIG. 4 is a block diagram showing a bypass circuit in the reference voltage generating circuit.

FIG. 4 is a block diagram illustrating an arrangement of the bypass circuit 41. The bypass circuit 41 is provided with the power elements such as (a) P-channel MOS transistors P1 and P2, whose source electrodes are respectively connected with high level power sources VLS, (b) N-channel MOS transistors, whose source electrodes are respectively connected to GND, (c) current adjusting resistance elements r1 and r2 for preventing over-current state, the current adjusting resistance elements r1 and r2 respectively connecting drain electrodes of the P-channel MOS transistor P1 and the N-channel MOS transistor N1 with the reference voltage V'64 among the 9 kinds of reference voltages (in other words, with the voltage input terminal T64), and (d) current adjusting resistance elements r3 and r4 for preventing over-current state, the current adjusting resistance elements r3 and r4 respectively connecting drain electrodes of the P-channel MOS transistor P2 and the N-channel MOS transistor N2 with the reference voltage V'0 among the 9 kinds of reference voltages (in other words, with the voltage input terminal T0). The current adjusting resistance elements r1, r2, r3, and r4 protect the respective transistors as the power elements.

Here, the P-channel MOS transistor P1, whose source electrode is connected with the power source VLS of high level, the N-channel MOS transistor N1, whose source electrode is connected to GND of low level, and the current adjusting resistance elements r1 and r2, correspond to first connecting means that is connected with a power source of high level and a power source of low level for supplying a DC current. The first connecting means is connected with the reference voltage V'64, which is one of the two ends of the reference voltages from the resistance divided circuit 40 as dividing means, where the two ends of the reference voltages correspond to the ends of the reference voltages in alignment.

Moreover, the P-channel MOS transistor P2, whose source electrode is connected with the power source VLS of high level, the N-channel MOS transistor N2, whose source electrode is connected to GND of low level, and the current adjusting resistance elements r3 and r4, correspond to second connecting means that is connected with a power source of high level and a power source of low level for supplying a DC current. The second connecting means is connected with the reference voltage V'0, which is one of the two of the reference voltages from the resistance divided circuit 40 as dividing means, where the two ends of the reference voltages correspond to the ends of the reference voltages in alignment.

With the logic circuit that turns ON or OFF each transistor as the power element in accordance with the polarity-inverted signal as described below, it is possible to output a positive voltage or a negative voltage from the first and second connecting means in a switching-over manner.

Moreover, the logic circuit turns ON or OFF each transistor as the power element also in accordance with the control signal TEST, which is, as described below, a switching signal for switch over an output from the reference voltage generating circuit 37. With this arrangement, for example, the bypass circuit 41 outputs the reference voltages V'64 and V'0 from the first and second connecting means when the control signal TEST is high, and outputs an analog voltage for gradation display, which is, for example, generated from the power supply VLS of high level, when the control signal TEST is low. With this, a display test can be easily performed, for example.

The logic circuit is provided with NAND circuits 51 and 52, NOR circuits 53 and 54, and inverter circuits 55 and 56. Gate electrodes of the P-channel MOS transistors P1 and P2 are respectively connected with output terminals of the NAND circuits 51 and 52, while gate electrodes of the N-channel MOS transistors N1 and N2 are respectively connected with output terminals of the NOR circuits 54 and 53. When each of the NAND circuits 51 and 52, and the NOR circuits 53 and 54 is supplied with the control signal TEST and the polarity-inverted signal POR, via inverter circuits 55 and 56, each power clement of the bypass circuit 41 carries out logic operation in accordance with a truth table as Table 1.

TABLE 1

| TEST | POR | P1 | P2 | N1 | N2 |
|---|---|---|---|---|---|
| Low | High | ON | OFF | OFF | ON |
| Low | Low | OFF | ON | ON | OFF |
| High | Low | OFF | OFF | OFF | OFF |
| High | High | OFF | OFF | OFF | OFF |

To begin with, explained is a case where the control signal TEST is "Low" and the polarity-inverted signal POR is "High". The inverter circuit 55 inverts the control signal TEST so as to cause one of inputs of the NAND circuit 51 to be "High", whereas the other input of the NAND circuit 51 is caused to be "High" in accordance with the polarity-inverted signal POR. Thereby, the NAND circuit 51 is caused to have a "Low" output, so that the P-channel MOS transistor P1 will be turned "ON". At the same time, the inverter circuit 56 inverts the polarity-inverted signal POR so as to cause one of inputs of the NOR circuit 53 to be "Low", while the other input of the NOR circuit 53 to be "Low" in accordance with the control signal TEST. Thereby, the NOR circuit 53 is caused to have a "High" output, so that the N-channel MOS transistor N2 will be turned "ON". Here, one of inputs of the NAND circuit 52 is caused to be "High", while the other input is caused to be "Low", thereby causing the NAND circuit 52 to have a "High" output. Thereby, the P-channel MOS transistor P2 is turned "OFF". At the same time, one of inputs of the NOR circuits 54 is caused to be "High", while the other input is caused to be "Low", so as to cause the NOR circuit 54 to have a "Low" output, thereby turning the N-channel MOS transistor N1 "OFF".

Therefore, a current from the resistance RO constituting the resistance divided circuit 40 is reinforced with a DC current that is supplied, via the P-channel MOS transistor P1 and the resistance element r1 from the high-level power source VLS, as a bypass other than a route from the liquid crystal driving power source REG. A current from the resistance R7 flows to GND via the resistance element r4 and the N-channel MOS transistor N2. In this way, the source driver 30 itself can compensate a current supplying ability as to the reference voltages V'64 to V'0, which are supplied from the liquid crystal driving power source REG, thereby ensuring stable supply of the reference voltages V'0 to V'64. Thereby, good display quality is ensured.

Next, a case where the control signal TEST is "Low" and the polarity-inverted signal POR is "Low" is explained. In this case, the NAND circuit 51 has a "High" input and a "Low" input, so that the NAND circuit 51 will have a "High" output, so as to turn the P-channel MOS transistor P1 "OFF". Meanwhile, the NOR circuit 53 has a "High" input and a "Low" input, so that an output of the NOR circuit 53 will be "Low", so as to turn the N-channel MOS transistor N2 "OFF". On the contrary, the NAND circuit 52 has "High" inputs, so that the NAND circuit 52 will have a "Low" output, so as to turn the P-channel MOS transistor P2 "ON". Meanwhile, the NOR circuit 54 has "Low" inputs, so that the NOR circuit 54 has a "High" output, so as to turn the N-channel MOS transistor N1 "ON".

Therefore, a current from the resistance R7 constituting the resistance divided circuit 40 is reinforced with a DC current that is supplied, via the P-channel MOS transistor P2 and the resistance element r3, from the high level power source VLS, as the bypass. A current from the resistance R0 flows to GND via the resistance r2 and the N-channel MOS transistor N1. In this way, the source driver 30 itself can compensate a current supplying ability as to the reference voltages V'64 to V'0, which are supplied from the liquid crystal driving power source REG.

Moreover, in this case, polarities of the reference voltages V'0 to V'64 are inverted. Thus, a case where the reference voltage V'64 is at a high level is positive, while a case where the reference voltage V'0 is at a high level is negative. In this way, the logic circuit automatically switches over the polarities of the analog voltages V0 to V63, in accordance with the polarity-inverted signal POR. Note that the logic circuit may be so arranged as to switch over the polarities of the analog voltages V0 to V63, instead of the polarity-inverted signal POR, by detecting voltages of the reference voltages V'0 and V'64, for example. In short, for example, the logic circuit may be so arranged that the logic circuit is provided with detecting means for detecting the reference voltages V'0 and V'64 so that the logic circuit turns ON or OFF each power element in accordance with an output of the detecting means so as to output the analog voltages V0 to V63 with polarities of the analog voltages V0 to V63 switched over.

On the contrary, when the control signal TEST is "High", the NAND circuits 51 and 52 output "High" outputs so as to turn the P-channel MOS transistors P1 and P2 "OFF", meanwhile the NOR circuits 53 and 54 output "Low" outputs so as to turn the N-channel MOS transistors N1 and N2 "OFF", regardless of state of the polarity-inverted signal POR. In this manner, $2_n$ kinds (here, 64 kinds) of the gradation display voltages V0 to V63 from the reference voltages V'0 to V'64 in plurality_outputted in the same way as the prior art. The number of the gradation display voltages V0 to V63, namely, $2^n$, corresponds to a bit number of the display data, that is, n bit.

Figure 5:
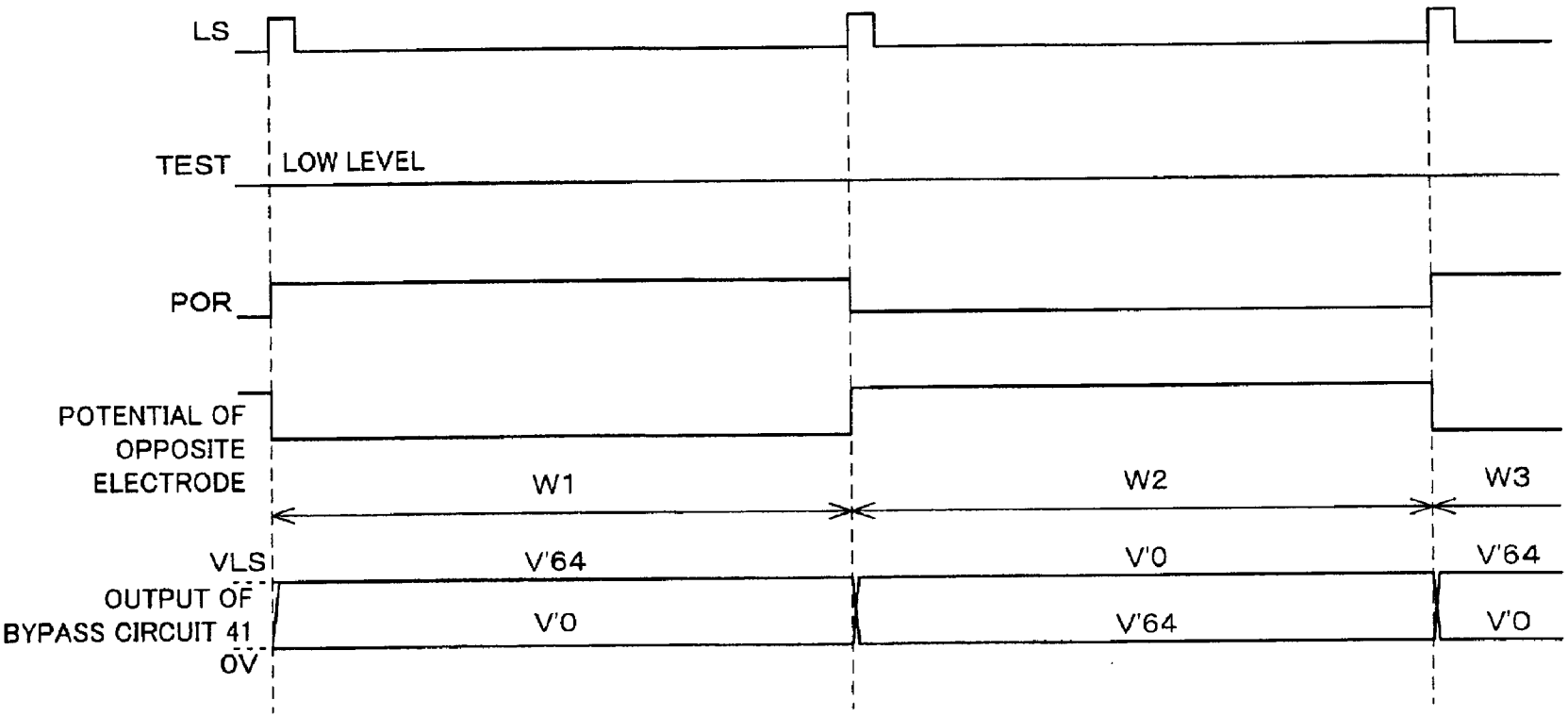
FIG. 5 is a waveform diagram explaining how the source driver operates.

FIG. 5 is a waveform diagram explaining how the source driver 30 having the above arrangement operates. The control signal TEST is a signal for use in a display test. When regular display is carried out, the control signal TEST is fixed to be "High" or "Low". According to FIG. 4 and the logic in Table 1, the control signal TEST is "Low". Therefore, again in FIG. 5, the control signal TEST is "Low". The polarity-inverted signal POR is a signal for performing AC driving. In FIG. 5, illustrated is how AC driving is operated under line-reversal drive scheme as an example. Thus, the polarity-inverted signal POR is inverted, together with a potential of an opposite electrode 3, when the horizontal synchronizing signal LS rises. A detailed explanation of the line-reversal drive scheme is disclosed, for example, in Japanese Publication of Unexamined Patent Application, Tokukaihei, No.11-272243 (published on Oct. 8, 1999), and the like.

On the other hand, as to the reference voltages V'0 and V'64, the reference voltage V'64 is VLS of high level, and the reference voltage V'0 is GND of the low level, during period for odd-numbered lines, such as periods W1, and W3. Meanwhile, the reference voltage V'0 is VLS of high level, and the reference voltage V'64 is GND of low level during periods for even-numbered lines, such as a period W2.

As described above, the source driver 30 of the present invention has such arrangement that the DC current flows, via the bypass other than the route from the liquid crystal driving source REG, at least from ends of the resistances R0 to R7 in series constituting the resistance divided circuit 40, thereby eliminating an output circuit in the arrangement. Thereby, it is possible for the source driver 30 itself to compensate current supply ability of the reference voltages V'64 to V'0 supplied from the liquid crystal driving power source REG, even if the gradation display voltage for directly driving liquid crystal is outputted from the resistances R0 to R7 via the analog switch SW0 to SW5. This prevents the gradation display voltage from having non-sharp rising and falling of the waveform and suppresses variation in voltages due to charging and discharging of a pixel capacitor 14.

Smaller resistance values of the resistances R0 to R7 increase the DC current, so that a range of variation in the analog voltages V63 to V0 gets narrower, while causing electric power consumption to be higher. Thus, the resistance values are set considering the electric power consumption and an acceptable range of variation in the analog voltages V63 to V0, so as to ensure to have an accurate gradation display voltage in which a shift of $\gamma$ characteristics and the like are suppressed. Moreover, low electric power consumption can be attained by providing one reference voltage generating circuit 37 in an IC of the source driver 30. The provision of the one reference voltage generating circuit 37 in the IC of the source driver 30 increases the electric power consumption of the resistances R0 to R7 as to the bypassed DC current, but the increase in the electric power consumption is sufficiently smaller than that caused by providing the output circuit in each output terminal 39. Furthermore, circuit space is significantly reduced by the provision of the one reference voltage generating circuit 37 in the IC of the source driver 30.

Furthermore, the reference voltage generating circuit 37 of the present invention, in which the bypass circuit 41 is added to a layout having the liquid crystal driving power source REG and the conventional reference voltage generating circuit 27, can be applied to a liquid crystal panel having a pixel capacity larger than that of its original structure. This enables the structure of the liquid crystal panel to be altered easily, and gives wider applicability to the source driver IC (the IC of the source driver 30). This leads to mass production of the source driver IC (producing mass production effect as to the source driver IC), which lowers a cost of the source driver IC.

Moreover, a resistance of a power source wire between the liquid crystal driving power source REG and the source driver 30 can be increased by reinforcing the power supply near the DA converting circuit 36 in the source driver 30. This reduces noise interference, thereby improving display quality.

Moreover, as described above, according to the present invention, the DA converting circuit 36, as selection means, selects one of the plurality of analog voltages from the reference voltage generating circuit 37, and outputs the selected voltage to each source signal line S of the liquid crystal panel 2 via the output terminal 39, as the gradation display voltage. In other words, the present invention requires no output circuit 28, which is provided to the conventional source driver 20. Thus, in the present invention, the DA converting circuit 36 directly outputs the gradation display voltage to the liquid crystal panel 2. Therefore, it is possible to realize miniaturization and low electric power consumption by eliminating the output circuit 28, which has a large layout area and high electric power consumption.

Note that in the above arrangement, described is the arrangement in which the control signal TEST for testing is used as the switching-over signal for switching over the output of the reference voltage generating circuit 37. However, the present invention is not limited to this. Apart from the control signal TEST, for example, a switching signal, with which the output is switched over appropriately, can be used so that the display driving apparatus can be applied to a small-sized liquid crystal panel or a large-sized liquid crystal panel, without changing the layout of the display driving apparatus. In short, for example in case of the large-sized liquid crystal panel, the control signal is set to be low so as to compensate the current supply ability of the reference voltage.

Described below is another embodiment of the present invention.

Figure 6:
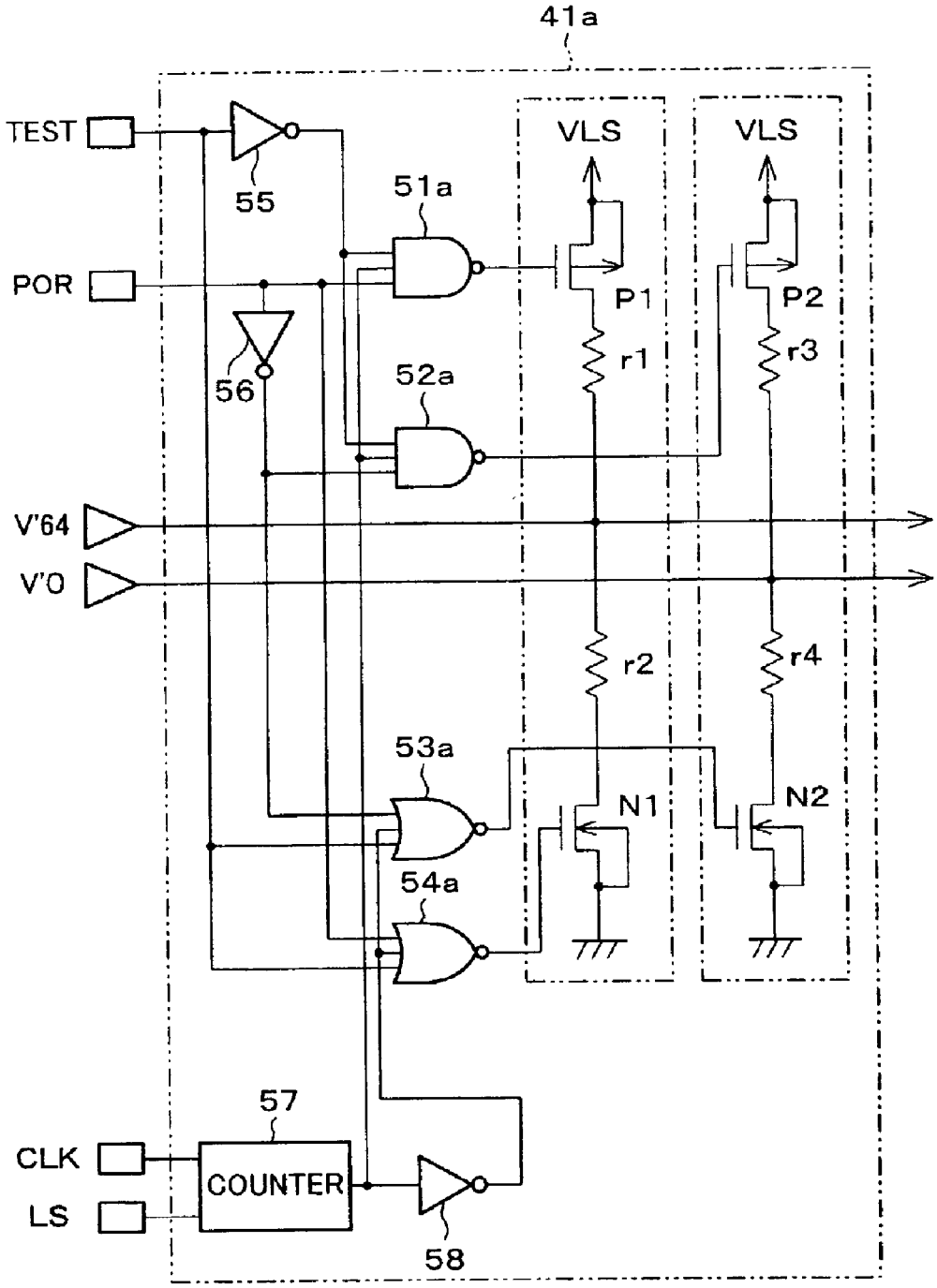
FIG. 6 is a block diagram showing an arrangement of a bypass circuit of a source driver of another embodiment of the present invention.

FIG. 6 is a block diagram illustrating an arrangement of a bypass circuit 41*a* of the another embodiment of the present invention. Since the bypass circuit 41*a* is similar to the bypass circuit 41, corresponding sections of the bypass circuit 41*a* are labeled with the same reference marks in the same manner as the bypass circuit 40, and their explanation is omitted here. It should be noted that the bypass circuit 41*a* is provided with NAND circuits 51*a* and 52*a* and NOR circuits 53*a* and 54*a*, which respectively correspond to the NAND circuits 51 and 52 and the NOR circuits 53 and 54, but which respectively have three input terminals, and is further provided with a counter 57 and an inverter circuit 58.

After initialized in accordance with the horizontal synchronizing signal LS, the counter 57 determines a period during which the DC current is supplied in accordance with a clock signal CK. An output of the counter 57 is supplied to additional inputs (third inputs) of the NAND circuits 51*a* and 52*a*. Meanwhile the output of the counter 57 is supplied to additional inputs of the NOR circuits 53*a* and 54*a* after inverted by the inverter circuit 58.

Figure 7:
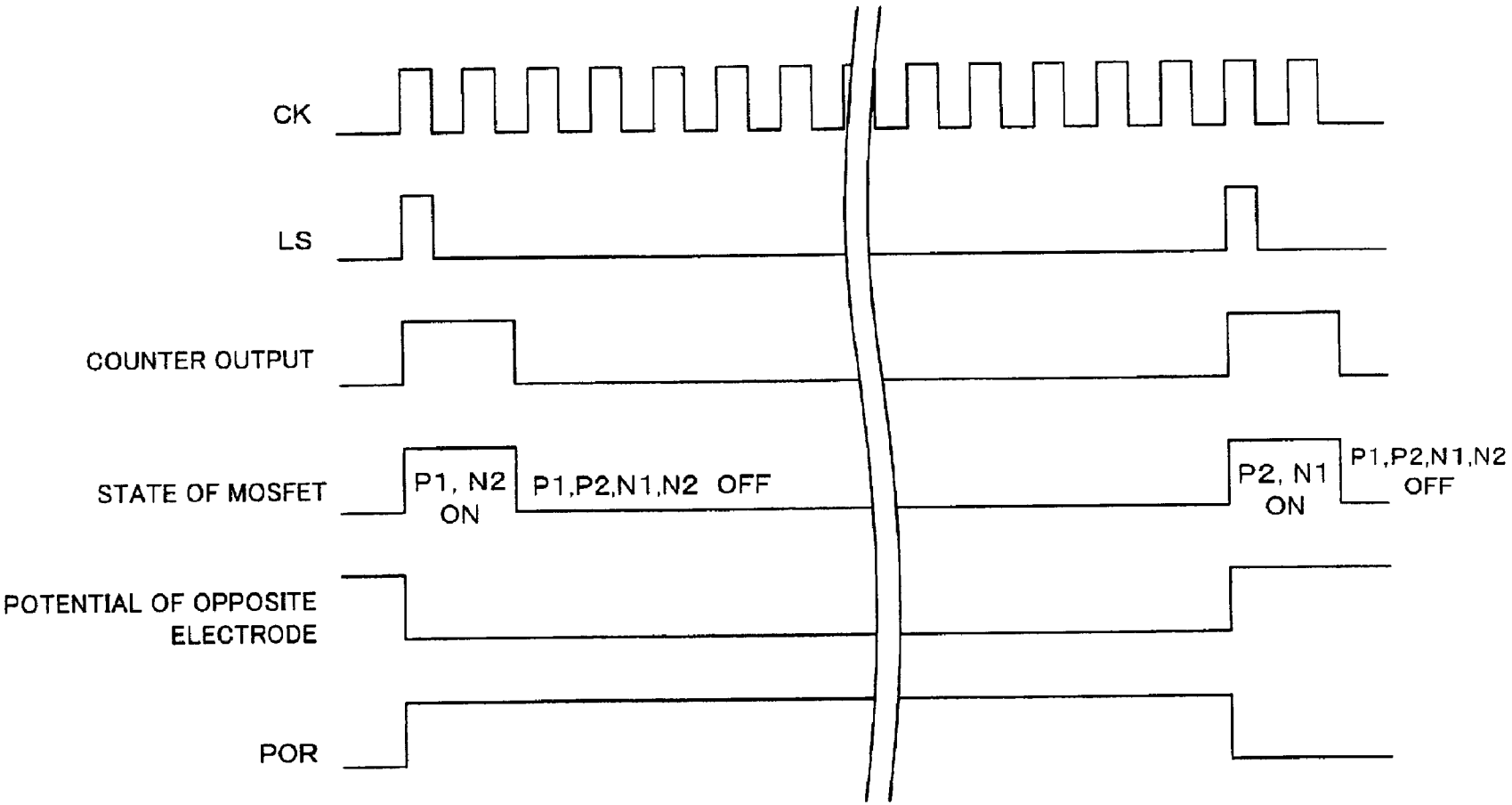
FIG. 7 is a waveform diagram showing how the bypass circuit shown in FIG. 6 operates.

FIG. 7 is a waveform diagram illustrating how respective sections of the bypass circuit 41*a* operate. The counter 57 outputs a "High" output after reset in accordance with the horizontal synchronizing signal LS. After counting the clock signal CK up to a predetermined counting value (in FIG. 7, until two pulses are counted), the counter 57 outputs a "Low" output. Therefore, the respective sections operate in the same way as in the above-mentioned embodiment, during a predetermined first part of a horizontal period during which the output of the counter 57 is "High". Thus, during the predetermined first period, the control signal TEST of "Low" causes a pair of the MOS transistors P1 and N2, or a pair of the MOS transistors P2 and N1 to be turned ON, so as to supply the DC current between the reference voltages V'64 to V'0. On the contrary, during a second predetermined period of the horizontal period during which the output of the counter 57 is "Low", both the pairs of the MOS transistors P1 and N2 and of the MOS transistors P2 and N1 are turned "OFF", so as to stop the supply of the DC current. Thus, the reference voltages V'64 to V'0 are outputted by using only the voltage supplied from the liquid crystal driving power source REG.

This is because the pixel capacitor 14 is charged and discharged rapidly in a predetermined period which is not late since inputting of the horizontal synchronizing signal LS, during which the gradation display signal is newly applied to a line. After the charging and discharging of the pixel capacitor 14 are ended, there is no flow of a large current, because no large current is necessary to maintain the gradation display voltage that is to be applied to each of source signal lines S. This further reduces the electric power consumption.

Furthermore, the counter 57 always has a counting value of zero (the counter 57 is always in a reset-state), when a signal fixed to be "High" is inputted into the counter 57 instead of the horizontal synchronizing signal LS to reset the counter 57. In this case, the output of the counter 57 is fixed to be "Low". In this case, the bypass circuit 41*a* stops operating, and the source driver 30 operates in the same way as a conventional source driver 20.

In this manner, the control signal TEST and the polarity-inverted signal POR, which are arbitrarily "pulled up" or "pulled down", are inputted to the liquid crystal panel 2. Thus, where there are a relatively large panel for which the bypass circuit 41*a* is operated, and a relatively small panel for which the bypass circuit 41*a* is not operated (stopped) as the liquid crystal panels 2, the same source driver is used for the relatively large panel and for the relatively small panel. Again in this way, the mass production effect is produced, thereby reducing the cost.

Still another embodiment of the present invention is explained below.

Figure 8:
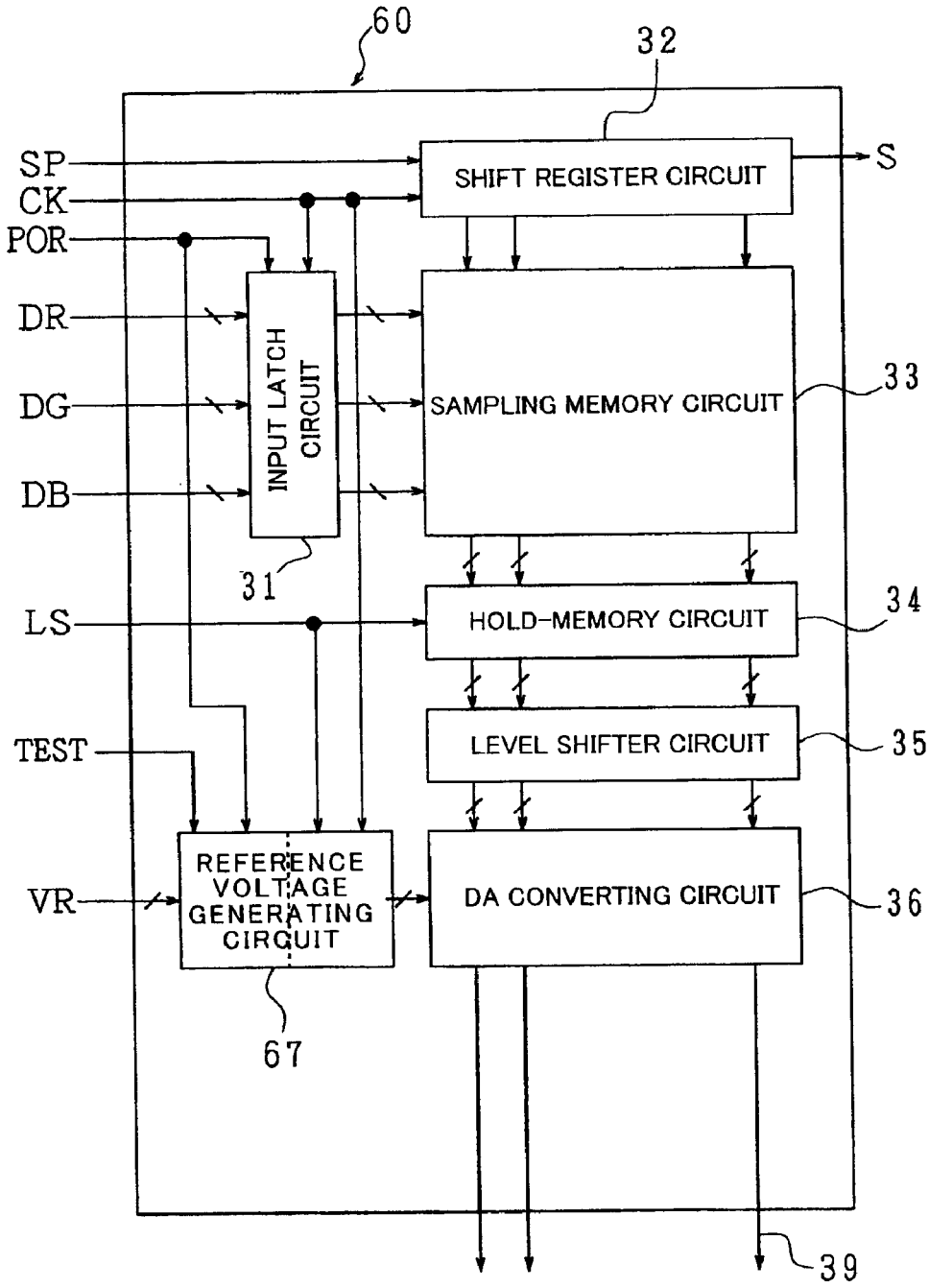
FIG. 8 is a block diagram illustrating an arrangement of a source driver that is a display driving apparatus of still another embodiment of the present invention.

FIG. 8 is a block diagram illustrating a source driver 60, which is a display driving apparatus of the still another embodiment of the present invention. The source driver 60 is also used as the source driver SD shown in FIG. 12. Thus, the source driver 60 is similar to the source driver 30. Thus, its corresponding parts are labeled with the same reference marks in the same manner as the source driver 30, and their explanation is omitted here. It should be noted that the source driver 60 is provided with a reference voltage generating circuit 67 including a pre-charge/discharge circuit 61 shown in FIGS. 9 and 10. Apart from this, the source driver 60 has the same arrangement as the source driver 30.

Figure 9:
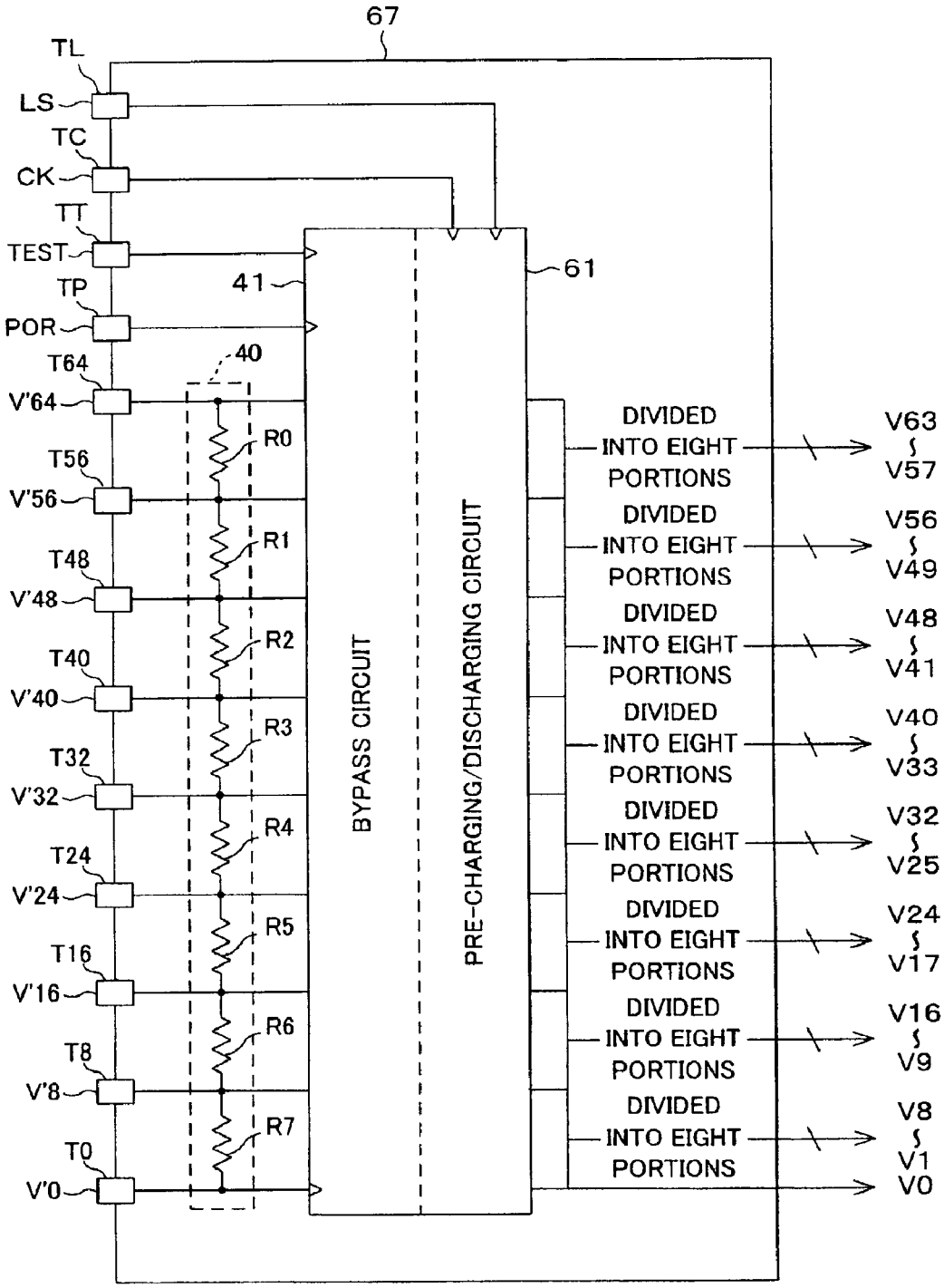
FIG. 9 is a block diagram schematically showing an arrangement of a reference voltage generating circuit in the source driver shown in FIG. 8.
Figure 10:
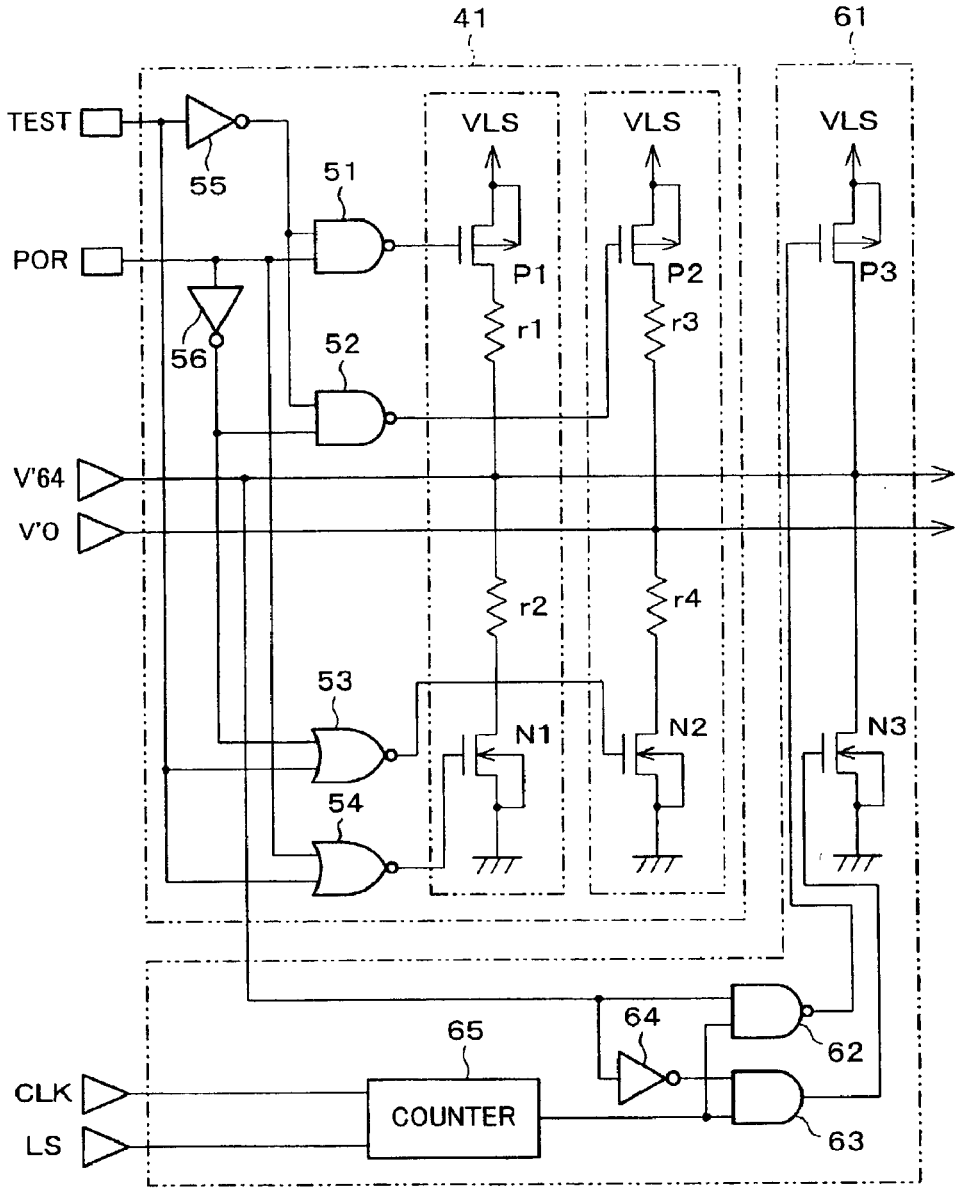
FIG. 10 is a block diagram specifically showing an arrangement of a pre-charge/discharge circuit in the reference voltage generating circuit.

FIG. 9 is a block diagram schematically illustrating the reference voltage generating circuit 67 provided with the pre-charge/discharge circuit 61, in addition to a resistance divided circuit 40 and a bypass circuit 41. FIG. 10 is a block diagram specifically showing the arrangement of the pre-charge/discharge circuit 61. The pre-charge/discharge circuit 61 is provided with two MOS transistors P3 and N3 (a P-channel MOS transistors P3 and an N-channel MOS transistor N3), an NAND circuit 62, an AND circuit 63, an inverter circuit 64, and a counter 65.

A source electrode of the P-channel MOS transistor P3 is connected to a power source VLS of high level, while a source electrode of the N-channel MOS transistor N3 is connected to GND. Drain electrodes of the MOS transistors P3 and N3 are commonly connected to a node for a reference voltage V'64 among 9 kinds of reference voltages. A gate electrode of the P-channel MOS transistor P3 is connected with an output terminal of the NAND circuit 62, while a gate electrode of the N-channel MOS transistor N3 is connected with an output terminal of the AND circuit 63. The NAND circuit 62, the AND circuit 63, the inverter circuit 64, and the counter 65 constitute a logic circuit. The reference voltage V'64 is supplied to one of input terminals of the NAND circuit 62. Meanwhile, the reference voltage V'64 is inverted by the inverter circuit 64 and supplied to one of input terminals of the AND circuit 63. Another input terminals of the NAND circuit 62 and the AND circuit 63 receive an output of the counter 65. After initialized in accordance with a horizontal synchronizing signal LS, which is supplied to a terminal TL, the counter 65 determines a pre-charge period and a discharge period in accordance with a clock signal CK.

Described blow is how the source driver 60 of the present embodiment operates. Here, it is assumed that the source driver 60 operates under line-reversal drive scheme. In the line-reversal drive scheme, AC component of a voltage applied onto an opposite electrode 3 (see FIGS. 12 and 13) has a cycle identical to that of a horizontal period. In short, when the line inverting driving method is employed, the opposite electrode 3 is AC driven in the same period as the horizontal period, using a single power source.

Here, the AC component of a data signal is varied in a predetermined cycle shorter than the horizontal period, the AC component of the data signal being centered at a center of amplitude of the AC component of the voltage applied onto the opposite electrode 3. The amplitude of the data signal is varied in accordance with gradation of a picture element. A polarity of the AC component of the data signal for a case where the gradation of the picture element is maximal, that is, where the picture element is to be in black is opposite to that of the AC component of the data signal for a case where the gradation of the picture element is minimal, that is, where the picture element is to be in white. However, whether the gradation of the picture element is maximal or minimal, the data signal has amplitude smaller than the amplitude of the AC component of the voltage applied onto the opposite electrode 3.

Figure 11:
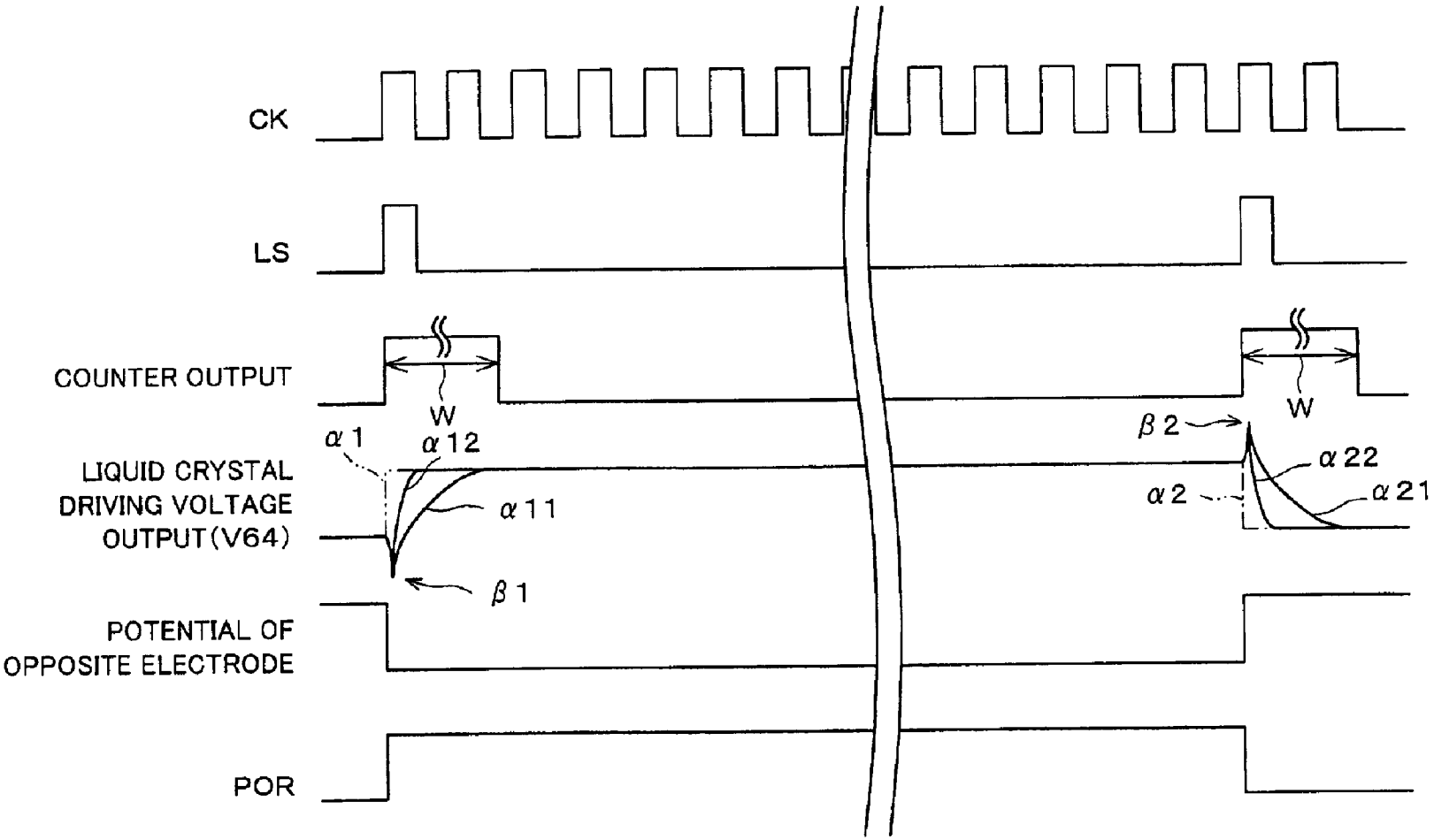
FIG. 11 is a waveform diagram explaining an overshoot and an undershoot of the liquid crystal driving voltage output caused when an AC signal of an opposite electrode is switched over.

Therefore, when an AC signal of the opposite electrode 3 is switched over with respect to a liquid crystal driving voltage output, an overshoot and an undershoot indicated by the reference marks β1 and β2 in FIG. 11 give a significant effect. The overshoot and undershoot occur due to load capacitors such as the pixel capacitor 14 and a capacitor of a source signal line S (see FIG. 13). The occurrence of the overshoot and undershoot causes rise time and fall time of an output of the liquid crystal driving voltage output to be increased beyond an ideal waveform indicated by the reference marks α1 and α2. As a result, the charging and discharging of the pixel capacitor 14 need a longer time, as indicated by the reference marks α11 and α21. Because of this, the pixel capacitor 14 is not charged within a gate ON period, thereby deteriorating display quality.

Moreover, for example, in case it is so arranged that the reference voltage V'0 has a largest amplitude while the reference voltage V'64 has a smallest amplitude, the output terminal of the reference voltage generating circuit 67 receives a maximal load when all outputs terminals for outputting the liquid crystal driving voltage output voltages of V0.

In view of this, in the present embodiment, one of the P-channel MOS transistor P3 and the N-channel MOS transistor N3 is selected in accordance with the amplitude of the reference voltage V'64 applied onto the one of the input terminals of the NAND circuit 62 and the one of the input terminals of the AND circuit 63. With this arrangement, the pre-charging or the discharging is carried out only during a period W determined by the counter 65, so as to prevent the time for charging and discharging the load capacitor from being prolonged, as indicated by the reference marks α12 and α22, thereby performing display practically without problems.

This arrangement effectively suppresses one of the overshoot and the undershoot of the output of the liquid crystal driving voltage due to the load capacitor, that one having a larger amplitude level, thereby ensuring better display quality.

In the above explanation, the pre-charging and discharging are carried out with respect to the reference voltage V'64, while in the previously discussed explanation the DC current is applied between the reference voltages V'0 and V'64, which are the minimum and the maximum among the reference voltages. The pre-charging and discharging and the application of the DC current with respect to the reference voltages V'0 and V'64 are minimal requirement for stabilization of the rest of the reference voltages, namely, the reference voltages V'8 to V'56. Apart from that, for example, an intermediate value between the maximum voltage and the minimum voltage is frequently used, the pre-charging and discharging and the application of the DC current may be carried out for a voltage of the intermediate value.

The present invention may be applied to a plasma display apparatus, which charges and discharges a pixel capacitor and carries out gradation control by an applied voltage, apart from the liquid crystal display apparatus.

A display driving apparatus of the present invention is so arranged that the reference voltage generating means includes (c) dividing means for dividing the reference voltage, and (d) bypass means for supplying a DC current at least from both ends of the dividing means, as a bypass other than a route from the power source.

With this arrangement, the DC current is supplied at least from the both ends of the dividing means, in other words, from between terminals for applying the largest reference voltage onto the dividing means, via the bypass means, which is the bypass other that the route from the power source. With this arrangement, it is possible to prevent a waveform of the liquid crystal driving voltage from having non-sharp rising and falling edges, or to prevent variation in voltage due to charging and discharging of the pixel capacitor, even if an output circuit is omitted from the arrangement. Thus, this ensures an accurate gradation display voltage in which a shift in γ characteristics is suppressed, even if no output circuit is provided.

Moreover, as described above, the display driving apparatus of the present invention may be so arranged that the bypass means of the reference voltage generating means includes (a) power elements for supplying the DC current, and (b) a logic circuit for turning ON or OFF the power elements so as to output a positive voltage or a negative voltage, as the analog voltages, in a switching-over manner in accordance with a polarity-inverted signal.

With this arrangement, it is possible to deal with an opposite AC driving.

Furthermore, as described above, the display driving apparatus of the present invention may be so arranged that the bypass means of the reference voltage generating means includes (a) power elements for supplying the DC current, and (b) a logic circuit, having a counter, for turning ON or OFF the power elements so as to supply the DC current only during a predetermined period.

With this arrangement, the charging and discharging of the display element are performed rapidly in the predetermined short period, which is in an early stage of new application of the gradation display voltage onto another output signal line. After the charging and discharging of the display element is finished, there is no flow of a large current, because no large current is necessary to maintain the gradation display voltage that is to be applied to each of source signal lines S. Thus, with this arrangement where the DC current is supplied only during the predetermined period, it is possible to further reduce the electric power consumption.

Moreover, the display driving apparatus may be so arranged that the bypass circuit is stopped operating when a signal for resetting the counter all the time is inputted, so that the display driving apparatus operates in the same manner as the conventional display driving apparatus. This allows the display driving apparatus to be used for (a) a relatively large panel for which the bypass means is operated, and (b) a relatively small panel for which the bypass means is not operated. Thereby, mass production of the display driving apparatus is attained so as to reduce the cost of the display driving apparatus.

Moreover, as described above, the display apparatus of the present invention may be so arranged that the reference voltage generating means includes pre-charging/discharging means having (a) power elements for supplying the DC current for pre-charging and discharging, and (b) a logic circuit for turning ON or OFF the power elements so as to supply, only during a predetermined period, the DC current for pre-charging and discharging.

With this arrangement, the pre-charging and discharging prevent the time period for charging and discharging the load capacitor from being prolonged, event if an overshoot or an undershoot occurs in the gradation display voltage output due to the load capacitor such as the pixel capacitor or the signal line when the AC signal of the opposite electrode is switched over. Thereby, it is possible to display without any practical problem. This arrangement suppresses the overshoot and undershoot in the gradation display voltage output due to load capacitor, thereby ensuring a better display quality.

Furthermore, as described above, the display driving apparatus of the present invention may be so arranged the logic circuit of the pre-charging/discharging means switches the pre-charging/discharging means to pre-charge or to discharge, in accordance with a maximum value and a minimum value of amplitude of the reference voltage.

With this arrangement, it is possible to effectively suppress one of the overshoot and undershoot, that one having a larger amplitude level.

Moreover, as described above, in the display driving apparatus of the present invention, the logic circuit turns ON or OFF each transistor in accordance with the polarity-inverted signal, so as to control the outputs of the first connecting means and the second connecting means, which are connected to the power source of high level and the power source of low level.

With this arrangement, the first and second connecting means respectively output a positive voltage and a negative voltage in a switching-over manner. In short, the present invention can be realized by such easy arrangement.

As described above, for example, it is an object of the display driving apparatus of the present invention to have the reference voltage generating circuit 37 being provided in the source driver of the liquid display apparatus, having no output circuit, such as a voltage follower circuit, which is conventionally provided for outputting the analog voltages V63 to V0, the reference voltage generating circuit 37 generating, by dividing the reference voltages V'64 to V'0 by means of the resistance divided circuit 40, into the plurality of analog voltages V63 to V0 for gradation display.

Therefore, as described above, the display driving apparatus of the present invention is so arranged that the reference voltage generating circuit includes the bypass circuit for supplying a DC current at least from both ends of the dividing means, as a bypass other than a route from the power source. With this arrangement, it is possible to prevent a waveform of the liquid crystal driving voltage from having non-sharp rising and falling edges, or to prevent variation in voltage due to charging and discharging of the pixel capacitor, even if an output circuit is omitted from the arrangement. Thus, this ensures an accurate gradation display voltage in which a shift in $\gamma$ characteristics is suppressed, even if no output circuit is provided.

As described above, a liquid crystal display apparatus of the present invention is so adopted to include a display driving apparatus having any one of those arrangements.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display driving apparatus, comprising (a) reference voltage generating means for generating, by dividing a reference voltage, a plurality of analog voltages for gradation display, the reference voltage being a DC voltage inputted from a power source, and (b) selection means for selecting a voltage corresponding to inputted display data from among the plurality of analog voltages for the gradation display, and for outputting thus selected voltage to a display panel as a gradation display voltage for driving a display element, wherein:

the reference voltage generating means includes (c) dividing means for dividing the reference voltage, and (d) bypass means for respectively supplying a separate DC current from a power source, other than that inputting the reference voltage, to at least one end of the dividing means.

2. The display driving apparatus as set forth in claim 1, wherein:

the bypass means of the reference voltage generating means includes (a) power elements for supplying the separate DC current, and (b) a logic circuit for turning ON or OFF the power elements so as to output a positive voltage or a negative voltage, as the analog voltages, in a switching-over manner in accordance with a polarity-inverted signal.

3. The display driving apparatus as set forth in claim 1, wherein:

the bypass means of the reference voltage generating means includes (a) power elements for supplying the separate DC current, and (b) a logic circuit, having a counter, for turning ON or OFF the power elements so as to supply the separate DC current only during a predetermined period.

4. The display driving apparatus as set forth in claim 1, wherein:

the reference voltage generating means includes pre-charging/discharging means having (a) power elements for supplying the separate DC current for pre-charging and discharging, and (b) a logic circuit for turning ON or OFF the power elements so as to supply, only during a predetermined period, the separate DC current for pre-charging and discharging.

5. The display driving apparatus as set forth in claim 4, wherein:

the logic circuit of the pre-charging/discharging means switches the pre-charging/discharging means to pre-charge or to discharge, in accordance with a maximum value and a minimum value of amplitude of the reference voltage.

6. The display driving apparatus as set forth in claim 2, wherein:

the bypass means includes (a) first connecting means that is connected to at least one end of the dividing means and to a power source of high level and a power source of low level, the power source of high level and the power source of low level supplying the separate DC current, and (b) second connecting means that is connected to another one of the at least one ends of the dividing means and to a power source of high level and a power source of low level, the power source of high level and the power source of low level supplying the separate DC current, the first and second connecting means having the power elements, and the logic circuit turning ON or OFF the power elements of the first and second connecting means in accordance with the polarity-inverted signal, so that the first and second connecting means respectively output a positive voltage or a negative voltage in a switching-over manner.

7. The display driving means as set forth in claim 6, wherein:

the reference voltage generating means includes a switching signal input terminal for outputting a current in a switching manner as to ON or OFF of the outputting, the current being obtained from the separate DC current, wherein the reference voltage generating means switches over whether or not the bypass means supplies the separate DC current, in accordance with the switching signal inputted to the switching signal input terminal.

8. The display driving apparatus as set forth in claim 7, wherein the switching signal is a test signal for use in a display test.

9. The display driving apparatus as set forth in claim 1, wherein the selection means outputs the gradation display voltage directly to the display panel.

10. The display driving apparatus as set forth in claim 1, wherein the dividing means is a resistance divided circuit in which resistance elements are connected in series.

11. A liquid crystal display apparatus, comprising:

a display driving apparatuses, wherein the display driving apparatus includes (a) reference voltage generating means for generating, by dividing a reference voltage, a plurality of analog voltages for gradation display, the reference voltage being a DC voltage inputted from a power source, and (b) selection means for selecting a voltage corresponding to inputted display data from among the plurality of analog voltages for the gradation display, and for outputting thus selected voltage to a display panel as a gradation display voltage for driving a display element, wherein the reference voltage generating means includes (c) dividing means for dividing the reference voltage, and (d) bypass means for respectively supplying a separate DC current from a source, other than that inputting the reference voltage, to at least one end of the dividing means.

12. A display driving apparatus, comprising:

a reference voltage generator for generating, by dividing a reference voltage, a plurality of analog voltages for gradation display, the reference voltage being a DC voltage inputted from a power source, and a selector circuit for selecting a voltage corresponding to inputted display data from among the plurality of analog voltages for the gradation display, and for outputting thus selected voltage to a display panel as a gradation display voltage for driving a display element, wherein:

the reference voltage generator includes a divider circuit for dividing the reference voltage, and a compensator circuit for supplying a DC current at least from both ends of the divider circuit, as a reinforcement current other than a route from the power source.

13. The display driving apparatus as set forth in claim 12, wherein:

the compensator circuit of the reference voltage generator includes power elements for supplying the DC current, and a logic circuit for turning ON or OFF the power elements so as to output a positive voltage or a negative voltage, as the analog voltages, in a switching-over manner in accordance with a polarity-inverted signal.

14. The display driving apparatus as set forth in claim 12, wherein:

the compensator circuit of the reference voltage generator includes power elements for supplying the DC current, and a logic circuit, having a counter, for turning ON or OFF the power elements so as to supply the reinforcement DC current only during a predetermined period.

15. The display driving apparatus as set forth in claim 12, wherein:

the reference voltage generator includes a pre-charger/discharger having power elements for supplying the DC current for pre-charging and discharging, and a logic circuit for turning ON or OFF the power elements so as to supply, only during a predetermined period, the DC current for pre-charging and discharging.

16. The display driving apparatus as set forth in claim 15, wherein:

the logic circuit of the pre-charger/discharger switches the pre-charger/discharger to pre-charge or to discharge, in accordance with a maximum value and a minimum value of amplitude of the reference voltage.

17. The display driving apparatus as set forth in claim 13, wherein:

the compensator circuit includes a first connecting circuit that is connected to one of the both ends of the divider circuit and to a power source of high level and a power source of low level, the power source of high level and the power source of low level supplying the reinforcement DC current, and a second connecting circuit that is connected to another one of the both ends of the divider circuit and to a power source of high level and a power source of low level, the power source of high level and the power source of low level supplying the reinforcement DC current, the first and second connecting circuits having the power elements, and the logic circuit turning ON or OFF the power elements of the first and second connecting circuits in accordance with the polarity-inverted signal, so that the first and second connecting circuits respectively output a positive voltage or a negative voltage in a switching-over manner.

18. The display driving apparatus as set forth in claim 17, wherein:

the reference voltage generator includes a switching signal input terminal for outputting a current in a switching manner as to ON or OFF of the outputting, the current being obtained from the DC current, wherein the reference voltage generator switches over whether or not the compensator Circuit supplies the reinforcement DC current, in accordance with the switching signal inputted to the switching signal input terminal.

19. The display driving apparatus as set forth in claim 18, wherein the switching signal is a test signal for use in a display test.

20. The display driving apparatus as set forth in claim 12, wherein the selector circuit outputs the gradation display voltage directly to the display panel.

21. The display driving apparatus as set forth in claim 12, wherein the divider circuit is a resistance divided circuit in which resistance elements are connected in series.

22. A liquid crystal display apparatus, comprising:

a display driving apparatuses, wherein the display driving apparatus includes reference voltage generator for generating, by dividing a reference voltage, a plurality of analog voltages for gradation display, the reference voltage being a DC voltage inputted from a power source, and a selector circuit for selecting a voltage corresponding to inputted display data from among the plurality of analog voltages for the gradation display, and for outputting thus selected voltage to a display panel as a gradation display voltage for driving a display element, wherein the reference voltage generator includes a divider circuit for dividing the reference voltage, and a compensator circuit for supplying a DC current at least from both ends of the dividing means, as a reinforcement current other than a route from the power source.

* * * * *